US011207881B2

(12) United States Patent
Deppisch et al.

(10) Patent No.: US 11,207,881 B2
(45) Date of Patent: Dec. 28, 2021

(54) SHEET PROCESSING MACHINE WITH SHAPING DEVICE AND UPPER SUCTION TRANSPORT MEANS

(71) Applicant: KOENIG & BAUER AG, Würzburg (DE)

(72) Inventors: Bastian Deppisch, Karlstadt (DE); Michael Donnert, Würzburg (DE); Christoph Häcker, Karlstadt (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/283,605

(22) PCT Filed: Jan. 27, 2020

(86) PCT No.: PCT/EP2020/051874
§ 371 (c)(1),
(2) Date: Apr. 8, 2021

(87) PCT Pub. No.: WO2020/160947
PCT Pub. Date: Aug. 13, 2020

(65) Prior Publication Data

US 2021/0309007 A1 Oct. 7, 2021

(30) Foreign Application Priority Data

Feb. 5, 2019 (DE) ..... 10 2019 102 775.6

(51) Int. Cl.
*B41F 21/08* (2006.01)
*B41F 5/24* (2006.01)
(Continued)

(52) U.S. Cl.
CPC ..... *B41F 21/08* (2013.01); *B26D 7/18* (2013.01); *B26F 1/384* (2013.01); *B41F 5/24* (2013.01);
(Continued)

(58) Field of Classification Search
None
See application file for complete search history.

(56) References Cited

U.S. PATENT DOCUMENTS 4,740,193 A 4/1988 Frost et al.
5,611,529 A 3/1997 Richarz et al.
(Continued)

FOREIGN PATENT DOCUMENTS

DE 102009046590 A1 5/2011
DE 202012013617 U1 8/2018
(Continued)

OTHER PUBLICATIONS

International Search Report of PCT/EP2020/051874 dated May 12, 2020.

*Primary Examiner* — Leslie A Nicholson, III
(74) *Attorney, Agent, or Firm* — Mattingly & Malur, PC

(57) ABSTRACT

A sheet processing machine has at least one shaping device and at least one sheet delivery unit, arranged downstream of the at least one shaping device along a transport path provided for a transport of sheets. The at least one shaping device has at least one shaping point which is formed by at least one forme cylinder, on one hand, and at least one impression cylinder, on the other hand. At least one separation device, for removing scrap pieces from sheets, is arranged downstream of the at least one shaping point along the transport path provided for the transport of sheets. The at least one separation device has at least one separation transport device. At least one transport device, configured as a selective transport device, is arranged following the at least one separation transport device along the transport path provided for the transport of sheets. The transport device is configured as at least one upper suction transport device for a hanging transport of sheets.

15 Claims, 8 Drawing Sheets

(51) Int. Cl.

| | |
|---|---|
| ***B26D 7/18*** | (2006.01) |
| ***B26F 1/38*** | (2006.01) |
| ***B65H 29/32*** | (2006.01) |
| ***B65H 31/10*** | (2006.01) |
| ***B65H 29/24*** | (2006.01) |
| *B26F 1/08* | (2006.01) |

(52) U.S. Cl.
CPC ..... *B65H 29/241* (2013.01); *B65H 29/32* (2013.01); *B65H 31/10* (2013.01); *B26F 1/08* (2013.01); *B65H 2301/44734* (2013.01)

(56) References Cited

U.S. PATENT DOCUMENTS

| | | | | |
|---|---|---|---|---|
| 6,131,901 | A | 10/2000 | Hirohata | |
| 9,027,737 | B2 * | 5/2015 | Talken | B26D 7/18 198/496 |
| 9,045,243 | B2 * | 6/2015 | Brown | B65B 11/00 |
| 9,427,927 | B2 | 8/2016 | Thies et al. | |
| 10,543,674 | B2 | 1/2020 | Bormann et al. | |
| 10,717,268 | B2 | 7/2020 | Bernard et al. | |
| 10,717,622 | B2 * | 7/2020 | Koch | B41F 13/70 |
| 10,967,534 | B2 * | 4/2021 | Talken | B26D 7/18 |
| 2010/0176549 | A1 | 7/2010 | Roth et al. | |
| 2011/0285080 | A1 | 11/2011 | Gendreau et al. | |
| 2012/0282074 | A1 | 11/2012 | Thies et al. | |

FOREIGN PATENT DOCUMENTS

| | | | |
|---|---|---|---|
| JP | 10-297808 | A | 11/1998 |
| JP | 2000-062981 | A | 2/2000 |
| WO | 2017/089421 | A1 | 6/2017 |
| WO | 2017/202848 | A1 | 11/2017 |

* cited by examiner

SHEET PROCESSING MACHINE WITH SHAPING DEVICE AND UPPER SUCTION TRANSPORT MEANS

CROSS-REFERENCE TO RELATED APPLICATION

This application is the US national phase, under 35 USC § 371, of PCT/EP2020/051874, filed Jan. 27, 2020; published as WO 2020/160947 A1 on Aug. 13, 2020, and claiming priority to DE 10 2019 102 775.6, filed Feb. 5, 2019, the disclosures of which are expressly incorporated herein by reference in their entireties.

FIELD OF THE INVENTION

The present invention relates to a sheet processing machine having a shaping device and an upper suction transport means.

BACKGROUND OF THE INVENTION

US 2010/0 176 549 A1 and US 2011/0 285 080 A1 each disclose a sheet delivery unit in which sheets are transported in a hanging state and are then released downward, during which process the rear area of the sheets is clamped in a clamping nip and decelerated. Prior to this, the sheets are transported lying flat.

From WO 2017/089421 A2 a sheet processing machine is known, which has a shaping device followed downstream by a separation device, configured as a cylinder pair, for removing scrap pieces, which is followed downstream by a selective transport means, which also has an upper suction transport means.

From DE 10 2009 046 590 A1 a delivery device is known, which has a circulating suction device by means of which paper bags can be transported individually hanging and can be deposited onto a delivery pile.

JP 2000 062 981 A and U.S. Pat. No. 6,131,908 A each disclose a sheet processing machine having a shaping device and a sheet delivery unit, in which a jogging device for removing scrap pieces from sheets is arranged downstream of a shaping point along a transport path provided for the transport of sheets, and in which following said jogging device along the transport path, a selective transport means is arranged, which is configured for a hanging transport of sheets.

U.S. Pat. Nos. 4,740,193 A and 5,611,529 A each disclose a delivery unit of a die-cutting device or cutting device.

From JP H10 297808 A a device is known in which a lower conveyor belt of a jogging device can be partially pivoted for the purpose of channeling sheets.

From DE 20 2012 013 617 U1 a cross-cutting device having a sheet diverter is known.

A sheet processing machine having a suction transport means is known from WO 2017/202848 A1.

SUMMARY OF THE INVENTION

The object of the present invention is to devise a sheet processing machine having a shaping device and an upper suction transport means.

The object is attained according to the invention by the provision of the sheet processing machine having at least one shaping device and at least one sheet delivery unit, arranged downstream of the at least one shaping device, along a transport path provided for a transport of sheets. The at least one shaping device has at least one shaping point which is formed by at least one forme cylinder, on one hand, and by at least one impression cylinder, on the other hand. At least one separation device, which may be configured as at least one jogging device, for removing scrap pieces of sheets, is arranged downstream of the at least one shaping point along the transport path provided for the transport of sheets. The at least one separation device has at least one separation transport device. At least one transport device configured as a selective transport device, is arranged following the at least one separation transport device, along the transport path provided for the transport of sheets. The transport device is configured as at least one upper suction transport device for a hanging transport of sheets. Additional transport devices, which are at least also configured as transport devices that act as upper suction transport devices or as transport devices for sheets that are provided for a hanging transport of sheets, are provided extending continuously from a point downstream of the at least one separation transport device to a point above a delivery pile carrier of the sheet delivery unit along the transport path provided for the transport of sheets.

A sheet delivery unit or a sheet processing machine that comprises a sheet delivery unit, for example, is preferred. The sheet processing machine preferably has at least one shaping device configured in particular as a rotary die-cutting device and/or and at least one sheet delivery unit arranged, in particular, downstream of the at least one shaping device or rotary die-cutting device along a transport path provided for the transport of sheets. The at least one shaping device preferably has at least one shaping point, in particular configured as a die-cutting point, which is further preferably formed by at least one plate cylinder, in particular configured as a die cylinder, on the one hand, and at least one counterpressure cylinder on the other.

Alternatively or additionally, the sheet processing machine is preferably characterized in that at least one separation device for removing scrap pieces from sheets is arranged downstream of the at least one shaping point along the transport path provided for the transport of sheets, said at least one separation device further preferably being configured as a jogging device and/or the scrap pieces being produced in particular at the at least one shaping point. Said at least one separation device preferably has at least one separation transport means for transporting sheets.

Alternatively or additionally, the sheet processing machine is preferably characterized in that at least one transport means configured as a selective transport means is arranged preferably following the at least one separation transport means, in particular directly following the at least one separation transport means, along the transport path provided for the transport of sheets, and is configured as at least one in particular exclusively upper suction transport means, in particular for an exclusively hanging transport of sheets. This produces the advantage that remaining scrap pieces can be easily removed from the sheets, in particular by gravity, while they still are being transported along the selective transport means, and can thereby be prevented from causing problems during the remainder of the handling process and/or the transport of the sheets, for example during the formation of the delivery pile. Another advantage is that maintenance can be easily performed from below on an upper suction device, even in the case of wide working widths. A further advantage is that printed images that are applied toward the bottom of the sheets are protected during transport.

Alternatively or additionally, the sheet processing machine is preferably characterized in that at least one transport means configured as a sheet decelerating means is arranged downstream of the at least one selective transport means along the transport path provided for the transport of sheets, and is arranged at least partially and/or fully above a delivery pile carrier of the sheet delivery unit. This enables sheets to be deposited particularly gently and precisely onto a delivery pile. Alternatively or additionally, the sheet processing machine is preferably characterized in that at least one sheet diverter for channeling sheets onto a transport path that bypasses the at least one sheet decelerating means is arranged between the at least one separation device and the at least one sheet decelerating means along the transport path provided for the transport of sheets. This enables sheets to be sorted out or removed for sampling purposes without affecting the delivery pile.

Alternatively or additionally, the sheet processing machine is preferably characterized in that transport means are arranged extending continuously from a point downstream of the at least one separation transport means to a point above a delivery pile carrier of the sheet delivery unit along the transport path provided for the transport of sheets, said transport means at least also being configured as transport means that act as upper suction transport means and/or as sheet transport means configured for a hanging transport of sheets. Alternatively or additionally, the sheet processing machine is preferably characterized in that transport means configured exclusively as upper suction transport means and/or sheet transport means configured for a hanging transport of sheets are arranged extending from a point downstream of the at least one separation transport means to a point above a delivery pile carrier of the sheet delivery unit along the transport path provided for the transport of sheets. The transfer of sheets from hanging transport to lying transport, or vice versa, can thereby be avoided, whereby the sheets are transported flat and are protected.

Alternatively or additionally, the sheet processing machine is preferably characterized in that at least one imbricating device is arranged in particular between the at least one selective transport means and/or the at least one sheet diverter on one hand and the at least one sheet decelerating means on the other along the transport path provided for the transport of sheets, said imbricating device having at least one transport means configured as an upper suction transport means and/or as a sheet infeed means. This enables sheets with particularly large dimensions to be deposited onto the delivery pile and/or in particularly rapid succession. Alternatively or additionally, the sheet processing machine is preferably characterized in that the at least one upper suction transport means of the at least one imbricating device is configured as a passively driven suction transport means. This facilitates imbrication and protects the sheets.

A further advantage of an imbricating device is, in particular, that excessive accelerations of inert components are not necessary. This saves energy and reduces wear and tear. Another advantage is that a succeeding sheet can at least partially overtake a leading sheet, thereby enabling relatively smooth movements of the sheets. Gentle handling of sheets is particularly advantageous in connection with corrugated cardboard.

Alternatively or additionally, the sheet processing machine is preferably characterized in that the at least one separation transport means is configured to act and/or to be capable of acting on sheets both from above and from below, and/or in that the at least one separation device has at least one collecting device for scrap pieces arranged beneath the transport path provided for the transport of sheets, and/or in that the at least one separation transport means has multiple upper separation transport belts arranged side by side and spaced apart from one another in a transverse direction and/or multiple lower separation transport belts arranged side by side and spaced apart from one another in a transverse direction.

Alternatively or additionally, the sheet processing machine is preferably characterized in that the at least one separation device is configured as at least one jogging device, and/or in that the at least one separation device has at least one jogging drive, and/or in that the at least one separation device has at least one jogging drive by means of which at least one separation transport belt can be deflected orthogonally to its localized transfer direction, and/or in that the at least one separation transport means has at least one transport drive, by means of which at least one component of the at least one separation transport means can be driven in circulation, in particular in at least one localized transfer direction.

The sheet delivery unit is preferably a sheet delivery unit of a sheet processing machine. The sheet delivery unit preferably has at least one rear sheet stop and at least one forward pile limiter. A delivery pile area is preferably delimited by the at least one rear sheet stop and the at least one forward pile limiter.

Alternatively or additionally, the sheet delivery unit is preferably characterized in that the sheet delivery unit has at least one upper sheet transport system configured for the hanging transport of sheets, having at least one imbricating device for the imbricated, hanging, in particular simultaneous transport of at least two sheets, in particular for the imbricated, hanging or guided hanging transport of at least two sheets at at least one point located above a delivery pile carrier and/or above a delivery pile and/or above the delivery pile area, as viewed in the vertical direction. This means, in particular, that the at least one upper sheet transport system configured for the hanging transport of sheets has at least one imbricating device, and that the at least one imbricating device is used to produce imbrication for an imbricated, hanging transport of at least two sheets at at least one point located above a delivery pile carrier and/or above a delivery pile and/or above the delivery pile area, as viewed in the vertical direction.

A direction of transport is preferably a horizontal direction that is oriented from the forward pile limiter toward the rear sheet stop. The sheet delivery unit preferably has at least one upper sheet transport system configured for the hanging transport of sheets, which more preferably has at least one sheet decelerating means configured as an upper suction transport means and even more preferably has at least one sheet infeed means configured as an upper suction transport means.

Alternatively or additionally, the sheet delivery unit is preferably characterized in that the at least one sheet infeed means is arranged at least partially upstream of the at least one sheet decelerating means with respect to the direction of transport. Alternatively or additionally, the sheet delivery unit is preferably characterized in that the at least one sheet infeed means extends in particular beyond the at least one forward pile limiter with respect to the direction of transport. Alternatively or additionally, the sheet delivery unit is preferably characterized in that at least one activatable and more preferably also deactivatable displacement element that acts downward, in particular that is capable of acting downward on sheets, is positioned such that its displacement region overlaps at least partially with respect to the direction of transport with a transport section of the transport path provided for the transport of sheets, said section being determined by the at least one sheet infeed means. The at least one displacement element preferably enables imbrication, thereby enabling a greater number of sheets to be delivered per unit of time. The at least one displacement element is configured, for example, as a displacement member and/or as a displacement opening. Alternatively or additionally, the sheet delivery unit is preferably characterized in that the at least one displacement element is positioned upstream of the at least one forward pile limiter. One potential advantage of this is that the at least one displacement element enables more sheets to be decelerated per unit of time.

Alternatively or additionally, the sheet delivery unit is preferably characterized in that the at least one sheet infeed means is configured as a suction transport means that is driven passively, in particular with respect to a transport of sheets in the direction of transport and/or in terms of its transport surfaces. This means, in particular, that respective movements of at least one transport surface of said at least one sheet infeed means are preferably moved only via respective contact with a respective sheet that is moved in another way. This enables at least two sheets to be held on said transport surface and transported at different speeds at the same time. Alternatively or additionally, the sheet delivery unit is preferably characterized in that at least one decelerating means drive is provided, by means of which the at least one sheet decelerating means can be driven, in particular with respect to movements of its at least one transport surface, at least in the direction of transport. This enables the sheet delivery unit to carry out a targeted deceleration of the sheets.

Alternatively or additionally, the sheet delivery unit is preferably characterized in that the at least one displacement element is configured as at least one displacement member, the position of which can be changed, at least by means of at least one displacement drive, between at least one pass-through position and at least one displacement position, and/or in that the at least one displacement element is configured as at least one displacement opening configured to emit a fluid. Alternatively or additionally, the sheet delivery unit is preferably characterized in that the at least one displacement element is configured as at least one displacement lever that can be turned, in particular pivoted and/or rotated, about a displacement axis, in particular by means of the at least one displacement drive. The displacement axis is preferably located above the reference surface. A transverse direction is preferably a horizontal direction that is oriented orthogonally to the direction of transport. The displacement axis is preferably oriented parallel to the transverse direction. Alternatively or additionally, the sheet delivery unit is preferably characterized in that the displacement axis is arranged upstream of the at least one forward pile limiter and/or upstream of the at least one sheet decelerating means, and/or in that the at least one displacement member, at least in at least one displacement position, is arranged at least partially upstream of the at least one forward pile limiter and/or upstream of the at least one sheet decelerating means, with respect to the direction of transport. This enables an optimized sequence of movements to be achieved because the beginning and the end of the region in which the displacement takes place are optimized.

Alternatively or additionally, the sheet delivery unit is preferably characterized in that at least one sheet transfer means configured as an upper suction transport means is arranged at least partially upstream of the at least one sheet infeed means and more preferably fully upstream of the at least one sheet infeed means with respect to the direction of transport, and/or in that the at least one sheet infeed means is arranged at least partially downstream of the at least one sheet transfer means with respect to the direction of transport, and/or in that the at least one sheet decelerating means is arranged fully downstream of the at least one forward pile limiter on the transport path provided for the transport of sheets and/or with respect to the direction of transport, and/or in that the at least one sheet infeed means is arranged at least partially upstream of the at least one forward pile limiter on the transport path provided for the transport of sheets and/or with respect to the direction of transport, and/or in that the at least one sheet decelerating means is the next transport means following the at least one sheet infeed means on the transport path provided for the transport of sheets and/or with respect to the direction of transport.

Alternatively or additionally, the sheet delivery unit is preferably characterized in that a respective contact region, in particular of the at least one sheet infeed means, is the respective, in particular, flat region in which contact is provided between a respective, in particular movable component of the at least one sheet infeed means on the one hand and a respective sheet to be transported on the other. A contact surface is preferably understood as a single coherent surface that comprises all the contact regions of the at least one sheet infeed means. A reference surface is preferably the contact surface, out of all the contact surfaces, that has both the shortest boundary line and the smallest surface area. Alternatively or additionally, the sheet delivery unit is preferably characterized in that in its at least one displacement position, the at least one displacement member protrudes downward through the reference surface in a displacement region, and more preferably in that in its at least one pass-through position, the at least one displacement member is positioned fully above the reference surface.

Alternatively or additionally, the sheet delivery unit is preferably characterized in that in at least one displacement position, the at least one displacement member protrudes downward in a displacement region through the reference surface by at least 1 mm, more preferably at least 2 mm, even more preferably at least 5 mm, even more preferably at least 9 mm, even more preferably at least 11 mm, and more preferably still at least 14 mm, and/or in that in at least one displacement position, the at least one displacement member protrudes downward in a displacement region through the reference surface by at least 100%, more preferably at least 120%, and even more preferably at least 150% of the maximum thickness of the sheets that can be processed by the sheet delivery unit. This ensures that there is enough space for an imbricated arrangement of even thick sheets.

Alternatively or additionally, the sheet delivery unit is preferably characterized in that the sheet delivery unit has at least one dropping means that can be moved between at least one standby position and at least one dropping position, and in that in its at least one standby position, the at least one dropping means is positioned fully above that part of a transport surface of the at least one sheet decelerating means that contributes to establishing a transport path provided for the transport of sheets, and in that in its at least one dropping position, the at least one dropping means protrudes at least partially downward to a point below said part of the transport surface of the at least one sheet decelerating means.

A sheet processing machine preferably comprises the at least one sheet delivery unit and/or at least one shaping unit or die-cutting unit and/or at least one application unit. The at least one application unit is preferably embodied as a flexo application unit and/or as a flexo printing unit. The sheet processing machine preferably comprises at least one substrate supply device configured as a sheet feeder.

Alternatively or additionally, the sheet processing machine is preferably characterized in that the pate cylinder of the shaping device, which is configured in particular as a die cylinder, is situated above the counterpressure cylinder that cooperates with it. This means, in particular, that the axis of rotation of said plate cylinder, which is configured in particular as a die cylinder, is situated at a greater height than the axis of rotation of the counterpressure cylinder that cooperates with it, in particular directly.

A method for operating a sheet processing machine is preferred in which processed substrate in the form of a sequence of sheets that are spaced apart from one another in a direction of transport is fed in said direction of transport, in particular at a transfer speed, to a sheet delivery unit of the sheet processing machine.

Alternatively or additionally, the method is preferably characterized in that, at least during a sheet decelerating process, at least two sheets are guided, at least temporarily, in a hanging state by means of an upper sheet transport system of the sheet delivery unit that is configured for the hanging transport of sheets and are transported in an imbricated arrangement at least also in the direction of transport.

Alternatively or additionally, the method is preferably characterized in that, in particular in a respective deceleration transfer process, the sheets are transported in each case in a hanging state by means of at least one sheet infeed means of the sheet delivery unit, configured as an upper suction transport means, and are transferred by the same to at least one sheet decelerating means configured as an upper suction transport means and more preferably arranged at least partially downstream of the at least one sheet infeed means, as viewed in the direction of transport.

Alternatively or additionally, the method is preferably characterized in that, in a displacement process, a respective trailing end of a respective leading sheet is forced downward away from the at least one sheet infeed means by means of at least one displacement element.

Alternatively or additionally, the method is preferably characterized in that, in a sheet decelerating process, this respective leading sheet is decelerated by means of the at least one sheet decelerating means, in particular with respect to movement in the direction of transport.

Alternatively or additionally, the method is preferably characterized in that, in an imbricating process a respective leading end of a respective sheet, in particular succeeding the respective leading sheet, is pushed, in particular by means of the at least one sheet transfer means, between the trailing end of the respective leading sheet and the at least one sheet infeed means, with respect to a vertical direction, while the respective leading sheet is still partially held by the at least one sheet decelerating means.

Alternatively or additionally, the method is preferably characterized in that in a detachment process, the respective leading sheet is detached completely from the at least one sheet decelerating means, in particular by means of at least one dropping means.

Alternatively or additionally, the method is preferably characterized in that, in a stacking process, the respective sheet that has just been detached is deposited downward from the at least one sheet decelerating means onto a delivery pile.

Alternatively or additionally, the method is preferably characterized in that the at least one sheet decelerating means is accelerated again following the detachment process, in particular to the transfer speed and/or to a processing speed, after which the respective succeeding sheet is brought into contact with the at least one sheet decelerating means.

Alternatively or additionally, the method is preferably characterized in that transport rollers of the at least one sheet infeed means are driven in rotation exclusively by the contact of these transport rollers with the respective moving sheet, and/or in that as sheets are being transported along the at least one sheet infeed means, they slide at least intermittently along at least one sliding surface of the at least one sheet infeed means.

Alternatively or additionally, the method is preferably characterized in that the delivery pile is formed between a forward pile limiter on the one hand and a rear sheet stop on the other hand, and in that the sheets are held, at least temporarily, by means of the at least one sheet infeed means in an area located vertically above the at least one forward pile limiter, in particular overhead, in particular while they are being transported. Alternatively or additionally, the method is preferably characterized in that, in the displacement process, the respective trailing end of the respective leading sheet is forced downward away from the at least one sheet infeed means by means of the at least one displacement element, at least also upstream of the at least one forward pile limiter with respect to the direction of transport.

Alternatively or additionally, the method is preferably characterized in that the at least one displacement element is configured as a displacement member and in the displacement process is moved at least partially to a point below a transport surface of the at least one sheet infeed means, and/or in that the at least one displacement element is configured as a displacement lever that can be rotated about a displacement axis and in the displacement process is rotated at least partially about the displacement axis, in particular in a direction of rotation D, to a point below a transport surface of the at least one sheet infeed means. The direction of rotation D is preferably characterized in that rotational movements of components of the at least one displacement member that rotate in the direction of rotation and that are located below the displacement axis with respect to the vertical direction have a directional component that is oriented parallel to the direction of transport.

Alternatively or additionally, the method is preferably characterized in that during the displacement process, the at least one displacement element is located at least partially beneath the reference surface of the at least one sheet infeed means. Alternatively or additionally, the method is preferably characterized in that the position of the at least one displacement element with respect to the direction of transport follows a predefined movement profile, in particular, as a function of time, at least during the displacement process. Alternatively or additionally, the method is preferably characterized in that the movement profile has at least one parabolic section and at least one linear section.

BRIEF DESCRIPTION OF THE DRAWINGS

Exemplary embodiments of the invention are illustrated in the set of drawings and will be described in greater detail in the following.

The drawings show.

DESCRIPTION OF PREFERRED EMBODIMENTS

Figure 1:
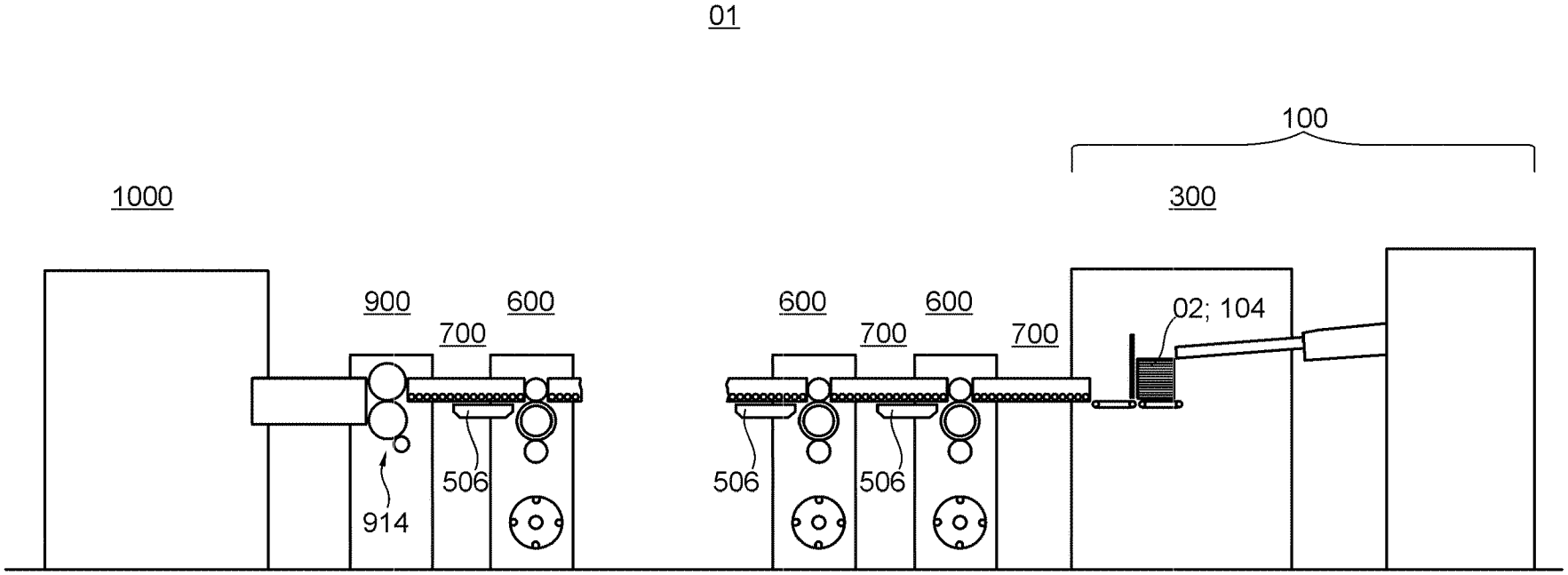
FIG. 1 a schematic representation of a sheet processing machine.
Figure 2:
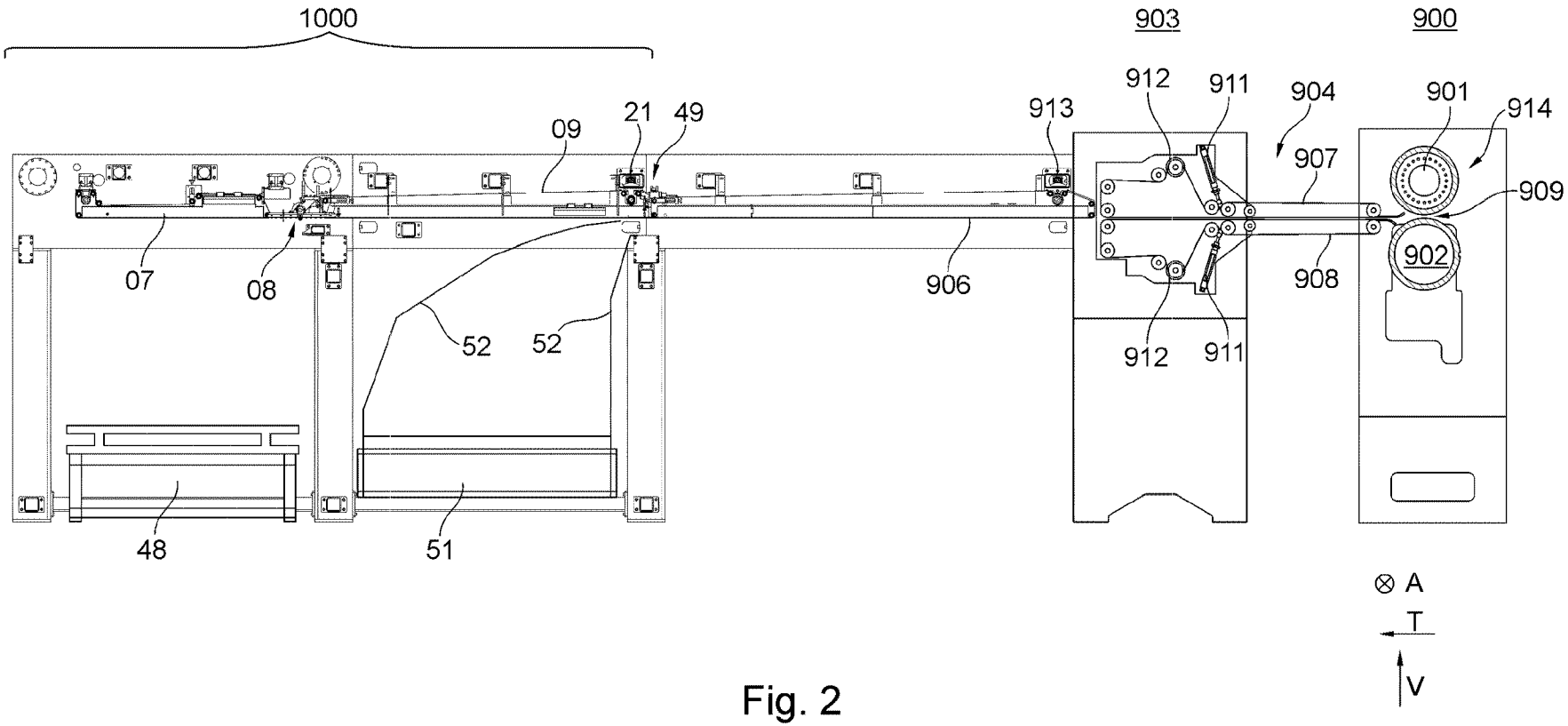
FIG. 2 a schematic representation of a shaping device and a sheet delivery unit.
Figure 3:
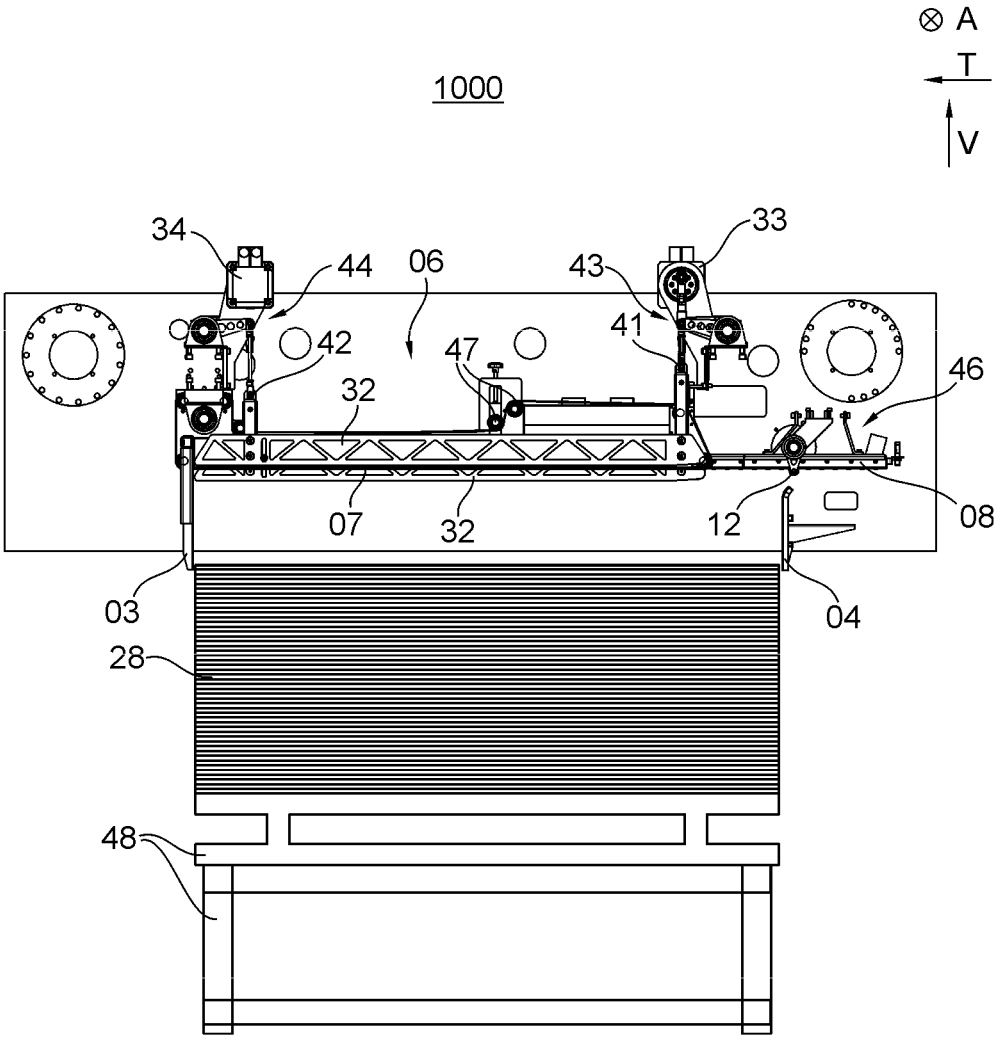
FIG. 3 a schematic representation of a section of a sheet delivery unit.
Figure 4A:
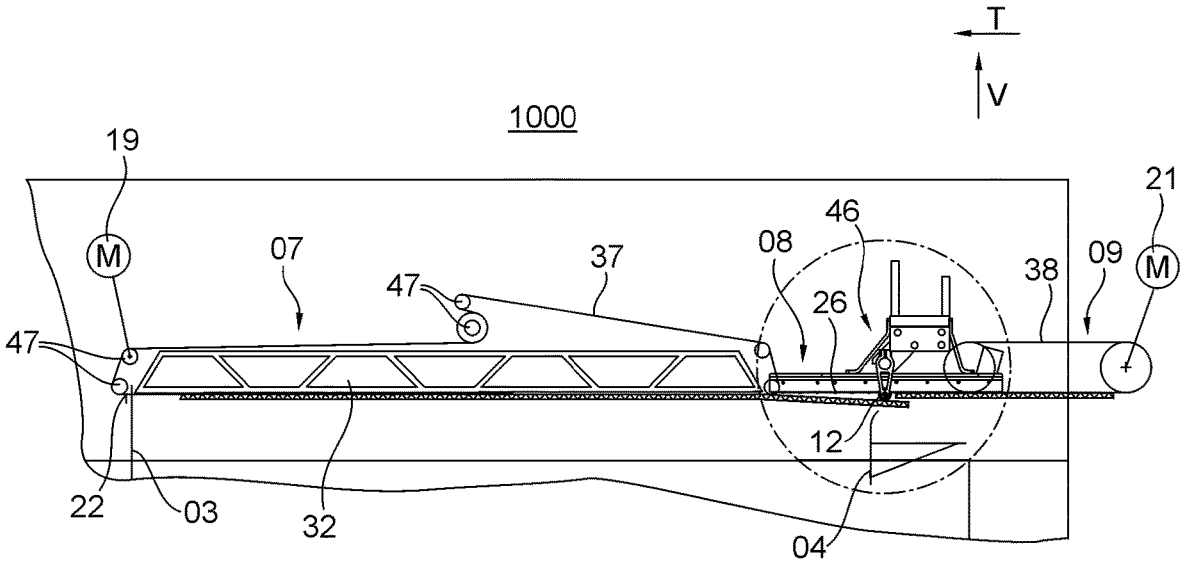
FIG. 4*a* a schematic representation of a section of a sheet delivery unit.
Figure 4B:
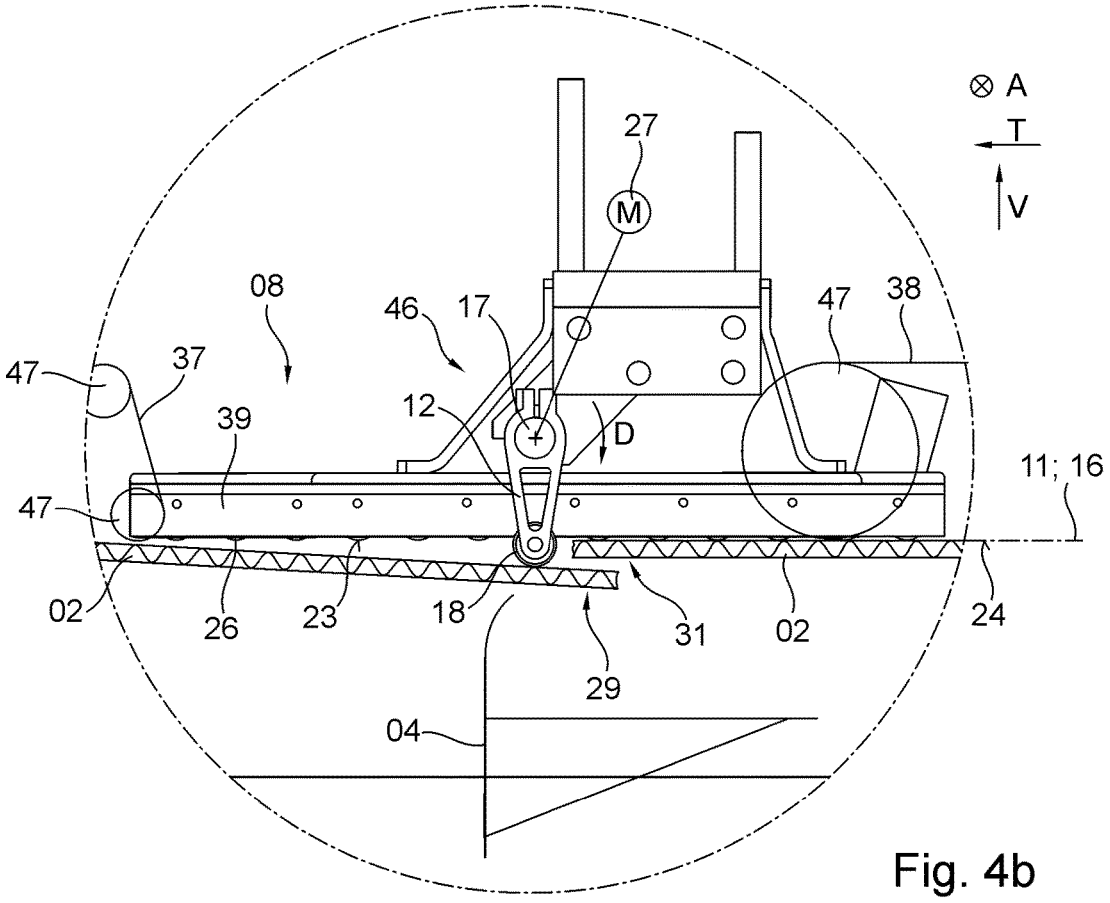
FIG. 4*b* a schematic representation of a detail from FIG. 4*a;*
Figure 5:
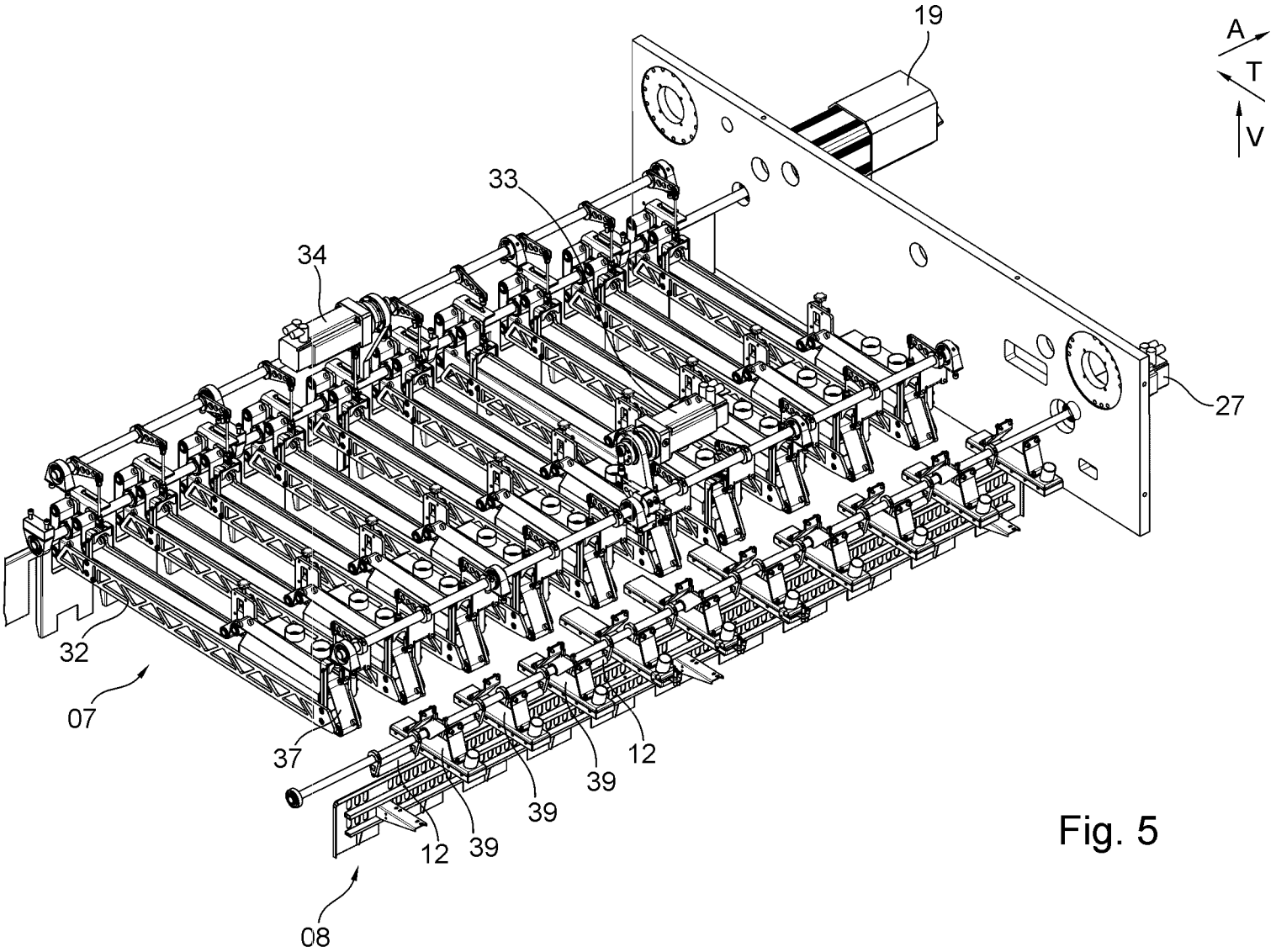
FIG. 5 a schematic representation of the section of the sheet delivery unit according to FIG. 3 in a perspective view.
Figure 6:
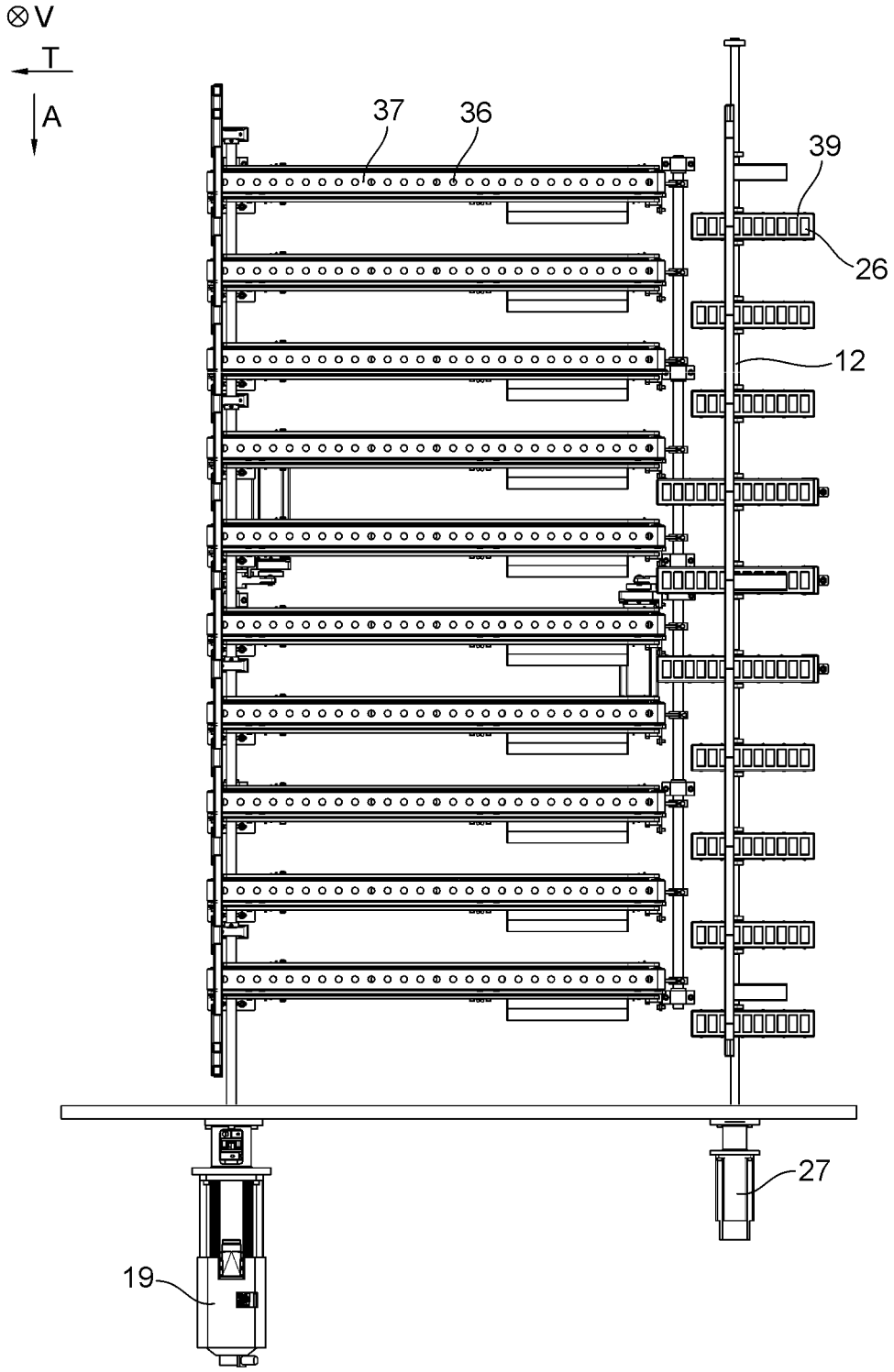
FIG. 6 a schematic representation of the section of the sheet delivery unit according to FIG. 3 in a view from beneath.
Figure 7:
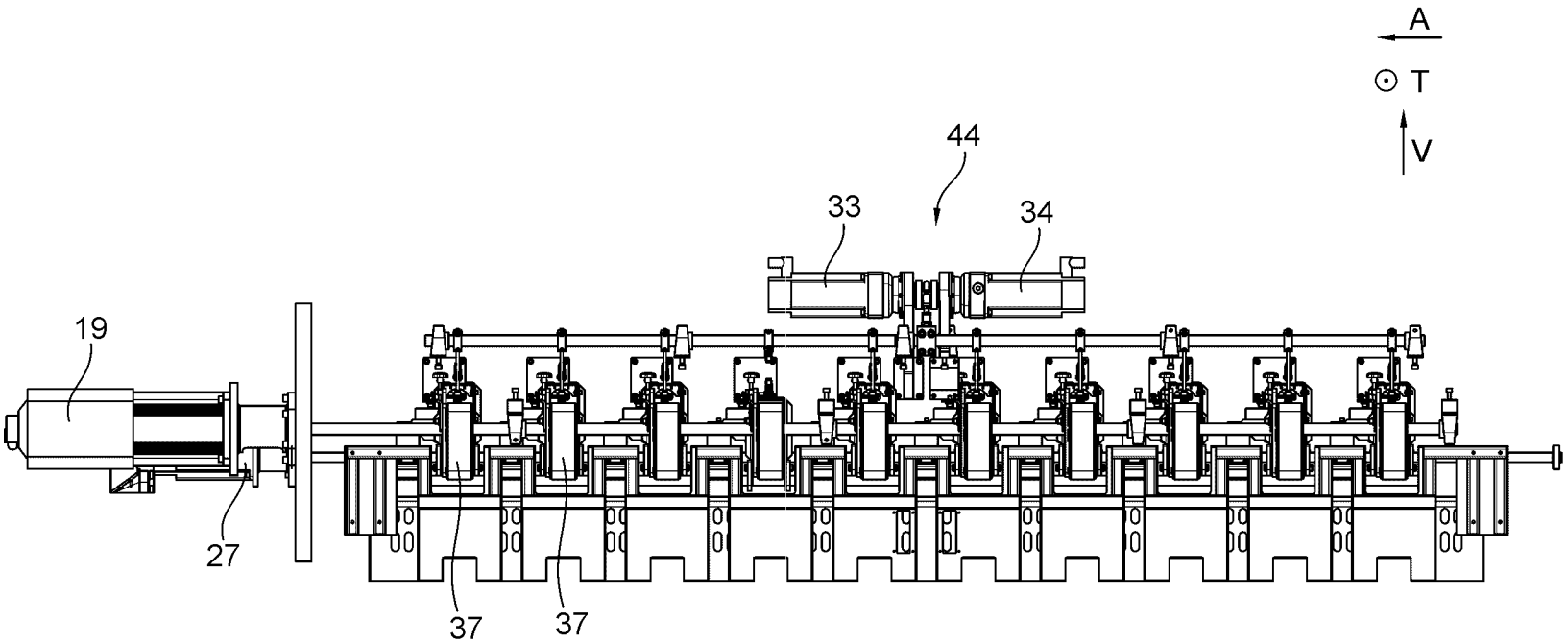
FIG. 7 a schematic representation of the section of the sheet delivery unit according to FIG. 3 in a view opposite a direction of transport.

In the foregoing and in the following, the term application fluid includes inks and printing inks, but also primers, lacquers, and pasty materials. Application fluids are preferably materials that are and/or can be transferred by means of a processing machine 01, in particular printing press 01, or by means of at least one application mechanism 614 or application unit 600 of processing machine 01, in particular at least one printing couple 614 or printing unit 600 of printing press 01, onto a substrate 02, in particular a printing substrate 02, thereby creating a preferably visible and/or perceptible and/or machine detectable texture, preferably in finely structured form and/or not merely over a large surface area, on the substrate 02, in particular printing substrate 02. Inks and printing inks are preferably solutions or dispersions of at least one colorant in at least one solvent, for example water and/or organic solvent. Alternatively or additionally, the application fluid may be an application fluid that cures under UV light. Inks are relatively low viscosity application fluids, and printing inks are relatively high viscosity application fluids. Inks preferably contain no binding agent or relatively little binding agent, whereas printing inks preferably contain a relatively large amount of binding agent, and more preferably contain additional auxiliary substances. In the foregoing and in the following, when application fluids and/or inks and/or printing inks are mentioned, this also includes colorless varnishes. In the foregoing and in the following, when application fluids and/or inks and/or printing inks are mentioned, this also preferably includes, in particular, agents for pretreating (priming or precoating) the printing substrate 02. The term printing fluid and the term coating medium are to be understood as synonymous alternatives to the term application fluid. A respective application fluid preferably is not gaseous. A respective application fluid is preferably liquid and/or powdered.

A processing machine 01 is preferably configured as a printing press 01 and/or as a shaping machine 01, in particular a die-cutting machine 01. The printing press 01 is configured as a flexo printing press 01, for example.

The processing machine 01 is preferably designated as a printing press 01 if it comprises at least one printing couple 614 and/or at least one printing unit 600, in particular regardless of whether it comprises additional units for processing substrate 02. A processing machine 01 configured as a printing press 01 also comprises, for example, at least one additional such unit 900, for example at least one shaping unit 900, which is preferably configured as a die-cutting unit 900. The processing machine 01 is preferably designated as a shaping machine 01 if it comprises at least one shaping mechanism 914 and/or at least one shaping unit 900, in particular regardless of whether it comprises additional units 600 for processing substrate 02. The processing machine 01 is preferably designated as a die-cutting machine 01 if it comprises at least one die-cutting mechanism 914 and/or at least one die-cutting unit 900, in particular regardless of whether it comprises additional units 600 for processing substrate 02. A processing machine 01 configured as a shaping machine 01 or die-cutting machine 01 also comprises, for example, at least one additional unit 600 for processing substrate 02, for example at least one printing unit 600 and/or at least one printing couple 614. Thus, if the processing machine 01 comprises at least one printing couple 614 and/or at least one printing unit 600 and also comprises at least one shaping mechanism 914 and/or at least one shaping unit 900, it is configured both as a printing press 01 and as a shaping machine 01. If the processing machine 01 comprises at least one printing couple 614 and/or at least one printing unit 600 and also comprises at least one die-cutting mechanism 914 and/or at least one die-cutting unit 900, it is therefore configured both as a printing press 01 and as a shaping machine 01, in particular a die-cutting machine 01.

The processing machine 01 is preferably configured as a sheet processing machine 01, i.e. as a processing machine 01 for processing sheet-format substrate 02 or sheets 02, in particular a sheet-format printing substrate 02. For example, the sheet processing machine 01 is configured as a sheet-fed printing press 01 and/or as a sheet-fed shaping machine 01 and/or as a sheet-fed die-cutting machine 01. The processing machine 01 is further preferably configured as a corrugated cardboard sheet processing machine 01, i.e. as a processing machine 01 for processing sheet-format substrate 02 or sheets 02 of corrugated cardboard, in particular sheet-format printing substrate 02 made of corrugated cardboard. More preferably, the processing machine 01 is configured as a sheet-fed printing press 01, in particular as a corrugated cardboard sheet printing press 01, i.e. as a printing press 01 for coating and/or printing sheet-format substrate 02 or sheets 02 of corrugated cardboard, in particular sheet-format printing substrate 02 made of corrugated cardboard. The printing press 01 is configured as a printing press 01 that operates according to a printing forme-based printing method, for example.

Unless an explicit distinction is made, the term sheet-format substrate 02, in particular printing substrate 02, specifically sheet 02, generally includes any flat substrate 02 in the form of sections, i.e. including substrates 02 in tabular form or panel form, i.e. including boards or panels. The sheet-format substrate 02 or sheet 02 thus defined is formed, for example, from paper or paperboard, i.e. as a sheet of paper or paperboard, or as sheets 02, boards, or optionally panels made of plastic, cardboard, glass, or metal. The substrate 02 is more preferably corrugated cardboard 02, in particular corrugated cardboard sheets 02. The thickness of a sheet 02 is preferably understood as the dimension orthogonally to the largest surface area of the sheet 02. This largest surface area is also referred to as the main surface area. The thickness of the sheets 02 is, for example, at least 0.1 mm, more preferably at least 0.3 mm, and even more preferably at least 0.5 mm. For sheets of corrugated cardboard 02, in particular, significantly greater thicknesses are also common, for example at least 4 mm or even 10 mm or more. Corrugated cardboard sheets 02 are relatively stable and therefore are not very flexible. Corresponding adjustments to the processing machine 01 therefore facilitate the processing of sheets 02 of great thickness.

The processing machine 01 preferably comprises multiple units 100; 300; 600; 700; 900; 1000. A unit in this context is preferably understood as a group of devices that cooperate functionally, in particular in order to carry out a preferably self-contained processing operation of sheets 02. At least two, for example, and preferably at least three, and more preferably all of the units 100; 300; 600; 700; 900; 1000 are configured as modules 100; 300; 600; 700; 900; 1000 or at least each is assigned to such a module. A module in this context is understood in particular as a respective unit or a structure made up of multiple units, which preferably has at least one transport means and/or at least its own controllable and/or regulatable drive, and/or as an independently functioning module and/or as an individually manufactured and/or separately assembled machine unit or functional assembly. A separately controllable and/or regulatable drive of a unit or module is understood in particular as a drive that is used to power the movements of components of said unit or module and/or that is used to transport substrate 02, in particular sheets 02, through said respective unit or module and/or through at least one processing zone of said respective unit or module and/or that is used to directly or indirectly drive at least one component of the respective unit or module that is intended for contact with sheets 02. Said drives of the units of the processing machine 01 are preferably embodied, in particular, as closed loop position-controlled electric motors.

Each unit 100; 300; 600; 700; 900; 1000 preferably has at least one drive control system and/or at least one drive controller, which is assigned to the respective at least one drive of the respective unit. The drive control systems and/or drive controllers of the individual units 100; 300; 600; 700; 900; 1000 can preferably be operated individually and independently of one another. Further preferably, the drive control systems and/or drive controllers of the individual units 100; 300; 600; 700; 900; 1000 are and/or can be linked in terms of circuitry, in particular by means of at least one BUS system, to one another and/or to a machine control system of the processing machine 01 in such a way that a coordinated control and/or regulation of the drives of multiple or of all units 100; 300; 600; 700; 900; 1000 of the processing machine 01 is and/or can be carried out. The individual units and/or particularly modules of the processing machine 01 therefore are and/or can be operated preferably electronically synchronized with one another, at least with respect to their drives, in particular by means of at least one electronic master axis. For this purpose, an electronic master axis is preferably specified, for example by a higher-level machine control system of the processing machine 01. Alternatively or additionally, the individual units of the processing machine 01 are and/or can be synchronized with one another mechanically, for example, at least with respect to their drives. Preferably, however, the individual units of the processing machine 01 are decoupled from one another mechanically, at least with respect to their drives.

Unless otherwise described, each of the units of the processing machine 01 is preferably characterized in that the section of a transport path provided for the transport of sheets 02, which is defined by the respective unit and in particular by the optionally provided at least one application unit 600, is at least substantially flat and more preferably completely flat. A substantially flat section of the transport path provided for the transport of sheets 02 is understood in this context as a section that has a minimum radius of curvature of at least 2 meters, more preferably at least 5 meters, and even more preferably at least 10 meters, and more preferably still at least 50 meters. A completely flat section has an infinitely large radius of curvature and is thus likewise substantially flat and therefore likewise has a minimum radius of curvature of at least 2 meters. Unless otherwise described, each of the units of the processing machine 01 is preferably characterized in that the section of the transport path provided for the transport of sheets 02, which is defined by the respective unit, extends at least substantially horizontally and more preferably exclusively horizontally. Said transport path preferably extends in a direction of transport T. A substantially horizontal transport path provided for the transport of sheets 02 means, in particular, that within the entire area of the respective unit, the provided transport path has only one or more directions that deviate no more than 30°, preferably no more than 15°, and more preferably no more than 5° from at least one horizontal direction. The direction of the transport path is particularly the direction in which the sheets 02 are transported at the point at which the direction is measured. The transport path provided for the transport of sheets 02 preferably begins at the point where the sheets 02 are removed from a feeder pile 104.

The processing machine 01 preferably has at least one substrate supply device 100, which more preferably is configured as a unit 100, in particular a substrate supply unit 100, and/or as a module 100, in particular a substrate supply module 100. In the case of a sheet processing machine 01, in particular, the at least one substrate supply device 100 is preferably configured as a sheet feeder 100 and/or sheet feeder unit 100 and/or sheet feeder module 100.

The processing machine 01 has, for example, at least one unit configured as a conditioning device, in particular a conditioning unit, which is more preferably configured as a module, in particular as a conditioning module. Such a conditioning device is configured, for example, as a pre-processing device or as a post-processing device. Preferably, the processing machine 01 has at least one unit configured as a pre-processing device, in particular a pre-processing unit, which more preferably is configured as a module, in particular as a pre-processing module and represents a conditioning device. The processing machine 01 preferably has at least one post-processing device. The processing machine 01 preferably has at least one infeed device 300, which is more preferably configured as an infeed unit 300 and/or infeed module 300. Alternatively, the at least one infeed device 300 is configured as a component of the substrate supply device 100 or of another unit.

The processing machine 01 preferably has at least one application unit 600, which is more preferably configured as a module 600, in particular application module 600. The at least one application unit 600 is positioned and/or structured based on its function and/or its application method. The at least one application unit 600 preferably serves to apply at least one respective application fluid or coating medium over the entire surface area and/or a portion of the surface area of the sheets 02. One example of an application unit 600 is a printing unit 600, which serves in particular to apply printing ink and/or ink to substrate, in particular sheets 02. In the foregoing and in the following, an optionally provided priming unit and/or an optional finish coating unit may also be considered as such an application unit 600 or printing unit 600.

Independently, in particular, of the function of the application fluid that can be applied by said application units 600, said units can preferably be distinguished in terms of their application method. One example of an application unit 600 is a forme-based application unit 600, which comprises, in particular, at least one fixed, physical, and preferably exchangeable printing forme. Forme-based application units 600 preferably operate according to a planographic printing process, in particular an offset planographic printing process, and/or according to a gravure printing process, and/or according to a letterpress printing process, particularly preferably according to a flexo printing process. In that case, the corresponding application unit 600 is a flexo application unit 600 or flexo printing unit 600, for example, in particular a flexo application module 600 or flexo printing module 600. The at least one application unit 600 preferably has at least one forme cylinder, which is further preferably arranged below an impression cylinder that cooperates with it, in particular directly. This means, in particular, that the axis of rotation of said forme cylinder is arranged at a lower height than the axis of rotation of the impression cylinder that cooperates with it, in particular directly.

The processing machine 01 has, for example, at least one unit configured as a drying device, in particular a drying unit, which is more preferably configured as a module, in particular as a drying module. Alternatively or additionally, at least one drying device 506 and/or at least one after-drying device, for example, is a component of at least one unit 100; 300; 600; 700; 900; 1000 preferably configured as a module 100; 300; 600; 700; 900; 1000. For example, at least one application unit 600 has at least one drying device 506 and/or at least one transport device 700 and/or at least one transport unit 700 has at least one drying device 506.

The processing machine 01 preferably has at least one transport device 700, which more preferably is configured as a unit 700, in particular transport unit 700, and/or as a module 700, in particular as transport module 700. The transport device 700 is also referred to as a transport means 700. Additionally or alternatively, the processing machine 01 preferably has transport devices 700, for example as components of other units and/or modules.

The processing machine 01 preferably has at least one shaping device 900 or die-cutting device 900, more preferably configured as a unit 900, in particular a shaping unit 900 or die-cutting unit 900, and/or as a module 900, in particular as a shaping module 900 or die-cutting module 900. Preferably, the processing machine 01 has at least one shaping unit 900 configured as a die-cutting unit 900. The at least one shaping device 900 is preferably configured as a rotary die-cutting device 900 and/or preferably has at least one shaping mechanism 914 or die-cutting mechanism 914. A shaping device 900 is also understood to be a stamping device and/or a creasing device. A perforating device is preferably likewise a form of a die-cutting device 900. The at least one shaping device 900 and/or the at least one shaping unit 900 is preferably characterized in that a section of the transport path provided for the transport of sheets 02, which is defined by the at least one shaping device 900 and/or the at least one shaping unit 900, is at least substantially flat and more preferably completely flat.

The processing machine 01 preferably has at least one unit 1000 configured as a substrate output device 1000, in particular configured as a sheet delivery unit 1000, in particular delivery unit 1000, which is more preferably configured as a module 1000, in particular as delivery module 1000.

The processing machine 01 has, for example, at least one unit configured as a post-press processing device, in particular a post-press processing unit, which is more preferably configured as a module, in particular as a post-press processing module.

The direction of transport T provided in particular for the transport of sheets 02 is a direction T that is oriented preferably at least substantially and more preferably completely horizontally and/or that preferably points from a first unit of the processing machine 01 toward a last unit of the processing machine 01, in particular from a sheet feeder unit 100 or a substrate supply device 100 on the one hand toward a delivery unit 1000 or a substrate output device 1000 on the other hand, and/or that preferably points in a direction in which the sheets 02 are transported, apart from vertical movements or vertical components of movements, in particular from a first point of contact with a unit of the processing machine 01 that is situated downstream of the substrate supply device 100 or a first point of contact with the processing machine 01 up to a last point of contact with the processing machine 01. Regardless of whether the infeed device 300 is an independent unit 300 or module 300 or is a component of the substrate supply device 100, the direction of transport T is preferably the direction T in which the direction of a horizontal component is oriented from the infeed device 300 toward the substrate output device 1000.

A transverse direction A is preferably a direction that is oriented orthogonally to the direction of transport T of the sheets 02 and/or orthogonally to the intended transport path of the sheets 02 through the at least one application unit 600 and/or through the at least one shaping unit 900 and/or through the at least one sheet delivery unit 1000. The transverse direction A is preferably a horizontally oriented direction A. A working width of the processing machine 01 and/or the at least one application unit 600 and/or the at least one shaping unit 900 and/or the at least one sheet delivery unit 1000 is preferably a dimension that extends preferably orthogonally to the intended transport path of the sheets 02 through the at least one application unit 600 and/or the at least one shaping unit 900 and/or the at least one sheet delivery unit 1000, more preferably in the transverse direction A. The working width of the processing machine 01 preferably corresponds to the maximum width a sheet 02 may have in order to still be processable by the processing machine 01, i.e. in particular a maximum sheet width that can be processed by the processing machine 01. In this context, the width of a sheet 02 is understood in particular as its dimension in the transverse direction A. This is preferably independent of whether this width of the sheet 02 is greater than or less than a horizontal dimension of the sheet 02, orthogonally thereto, which more preferably represents the length of said sheet 02. The working width of the processing machine 01 preferably corresponds to the working width of the at least one application unit 600 and/or the at least one shaping unit 900 and/or the at least one sheet delivery unit 1000. The working width of the processing machine 01, in particular sheet processing machine 01, is preferably at least 100 cm, more preferably at least 150 cm, even more preferably at least 160 cm, even more preferably at least 200 cm, and more preferably still at least 250 cm.

The processing machine 01 preferably has transport means 07; 08; 09; 904 at one or more locations. At least one of said transport means 07; 08; 09 is preferably configured as a suction transport means 07; 08; 09, in particular as a suction belt 07; 09 and/or as a suction box belt and/or as a roller suction system 08 and/or as a suction roller. Such suction transport means 07; 08; 09 preferably serve to move sheets 02 forward in a controlled manner and/or to enable movements while sheets 02 are held against at least one counterpressure surface of the corresponding suction transport means. A relative vacuum is preferably used to pull and/or to press the sheets 02 against at least one transport surface 22; 23; 24. A transporting movement of the sheets 02 is preferably produced by a corresponding, in particular circulating movement of the at least one transport surface 22; 23; 24. Alternatively or additionally, the sheet 02 is held in its path, for example along the transport path provided for the transport of sheets 02, by the at least one suction transport means, and a transporting movement of the sheet 02 is produced by a force that is defined by another transport means situated upstream and/or downstream, for example. Said vacuum is in particular a vacuum relative to an ambient pressure, in particular relative to an atmospheric pressure.

A suction transport means 07; 08; 09 is therefore preferably understood as a device that has at least one counterpressure surface 22; 23; 24, which more preferably is configured as a sliding surface and/or as a movable transport surface 22; 23; 24, in particular, and which is at least partially movable, for example, at least in the direction of transport T. Further, the respective suction transport means 07; 08; 09 preferably has at least one vacuum chamber, which more preferably is connected by means of a suction line to at least one vacuum source. The vacuum source has a fan, for example. The at least one vacuum chamber has at least one suction opening, which is used to apply suction to the sheets 02. Depending on the embodiment of the suction transport means 07; 08; 09 and the size of the sheets 02, the sheets 02 are drawn by suction into a position in which they close off the at least one suction opening or are merely drawn by suction against a counterpressure surface 22; 23; 24 in such a way that ambient air can still travel past the sheets 02 and into the suction opening. The transport surface 22; 23; 24 has one or more intake openings 36, for example. The intake openings 36 preferably serve to convey a vacuum from the suction opening of the vacuum chamber up to the transport surface 22; 23; 24, in particular without pressure losses or with very low pressure losses. Alternatively or additionally, the suction opening acts on the sheets 02 in such a way that the sheets are drawn by suction against the transport surface 22; 23; 24, even though the transport surface 22; 23; 24 has no intake openings 36. At least one deflecting means 47 is provided, for example, which directly or indirectly ensures a circulating movement of the at least one transport surface 22; 23; 24. The at least one deflecting means 47 and/or the transport surface 22; 23; 24 preferably is and/or can be self-propelled, in particular to provide for movement of the sheets 02. Alternatively, the transport surface allows sheets 02 to slide along the transport surface.

A first embodiment of a suction transport means 07; 09 is a suction belt 07; 09. A suction belt 07; 09 in this context is understood as a device that comprises at least one flexible transport belt 37; 38, the surface of which serves as a transport surface 22; 24. The at least one transport belt 37; 38 is preferably deflected by deflecting means 47 configured as deflecting rollers 47 and/or deflecting cylinders 47 and/or is preferably self-contained, in particular such that endless circulation is enabled. The at least one transport belt 37; 38 preferably has a multiplicity of intake openings 36. The at least one transport belt 37; 38 preferably covers the at least one suction opening of the at least one vacuum chamber over at least a portion of its circulation path. In that case, the vacuum chamber is further preferably connected to the surrounding environment and/or to sheets 02 only via the intake openings 36 of the at least one transport belt 37; 38. Support means are preferably provided, which prevent the at least one transport belt 37; 38 from being pulled too far or at all into the vacuum chamber and/or which ensure that the transport surface 22; 24 assumes a desired shape, for example such that it forms a flat surface, at least in the region in which its intake openings 36 are connected to the vacuum chamber. A circulating movement of the at least one transport belt 37; 38 then results in a forward movement of the transport surface 22; 24, with sheets 02 being held securely on the transport surface 22; 24 precisely in the region where they lie opposite the suction opening that is covered by the at least one transport belt 37; 38, with the exception of the intake openings 36.

A second embodiment of a suction transport means 08 is a roller suction system 08. A roller suction system 08 in this context is understood as a device in which the at least one transport surface 23 is formed by at least sections of lateral surfaces of a multiplicity of transport rollers 26 and/or transport cylinders 26. Thus, each of the transport rollers 26 and/or transport cylinders 26 forms a part of the transport surface 23 that is closed, for example, and/or that circulates via rotation. The roller suction system 08 preferably has a multiplicity of suction openings. These suction openings are preferably arranged at least between adjacent transport rollers 26 and/or transport cylinders 26. At least one cover mask is provided, for example, preferably forming a boundary of the vacuum chamber. The cover mask preferably comprises the multiplicity of suction openings. The cover mask preferably forms a substantially flat surface. The transport rollers 26 and/or transport cylinders 26 are preferably arranged in such a way that they are intersected by said flat surface and more preferably protrude only slightly, for example only a few millimeters, above said flat surface, in particular in a direction facing away from the vacuum chamber. In that case, the suction openings are preferably configured as frame-like, with each opening surrounding at least one of the transport rollers 26 and/or transport cylinders 26. A circulating movement of the transport rollers 26 and/or transport cylinders 26 then results in a forward movement of the corresponding parts of the transport surface 23, with sheets 02 being held securely on the transport surface 23 precisely in the region in which they lie opposite the suction opening.

A third embodiment of a suction transport means is a suction box belt. A suction box belt is understood in this context as a device that comprises a plurality of circulating suction boxes, in particular, each of which has an outer surface that serves as a transport surface.

A fourth embodiment of a suction transport means is at least one suction roller. A suction roller in this context is understood as a roller the lateral surface of which serves as a transport surface and has a multiplicity of intake openings, and which has at least one vacuum chamber in its interior, which is connected to at least one vacuum source, for example by means of a suction line.

A fifth embodiment of a suction transport means is at least one sliding suction device. The sliding suction device is preferably configured as a passive transport means and serves, in particular, to establish boundary conditions with respect to the position of a respective sheet 02, without setting the sheet 02 itself in motion. The respective sliding suction device preferably has at least one sliding surface and at least one vacuum chamber and at least one suction opening. Said at least one sliding surface then serves as a counterpressure surface and serves as a transport surface. In the case of the sliding suction device, the transport surface configured as a sliding surface preferably is not moved. The sliding surface serves as a counterpressure surface against which corresponding sheets 02 are pressed. The sheets 02 can nevertheless be moved along the sliding surface, in particular to the extent that they are acted upon otherwise by a force that is at least also oriented parallel to the sliding surface. A region between two actuated suction transport means can be bridged by means of a sliding suction device, for example.

It is possible for different embodiments of suction transport means to be combined. Said suction transport means may have at least one common vacuum source and/or at least one common vacuum chamber and/or at least may cooperate as a suction transport means and/or may be arranged in a row and/or side by side. Each such combination is then preferably assigned to at least two of the embodiments of suction transport means.

Regardless of the embodiment of the respective suction transport means 07; 08; 09, at least two configurations of the respective suction transport means 07; 08; 09 as described below are possible.

In a first configuration, a section of the transport path provided for the transport of sheets 02, said section being defined by the respective suction transport means 07; 08; 09, is situated below the transport surface 22; 23; 24, which is movable, in particular, and which serves, in particular, as a counterpressure surface 22; 23; 24 and is movable at least partially, for example, at least in the direction of transport T. In that case the respective suction transport means 07; 08; 09 is configured as an upper suction transport means 07; 08; 09, for example, with the suction openings or intake openings 36 thereof further preferably facing preferably at least also or only downward, at least while they are connected to the at least one vacuum chamber, and/or the suctioning action thereof preferably being directed at least also or only upward. The sheets 02 are then preferably transported in a hanging state by the suction transport means 07; 08; 09.

In a second configuration, a section of the transport path provided for the transport of sheets 02, said section being defined by the respective suction transport means, is situated above the especially movable transport surface, which serves in particular as a counterpressure surface and is movable at least partially, for example, at least in the direction of transport T. In that case the respective suction transport means is configured as a lower suction transport means, for example, with the suction openings or intake openings thereof further preferably facing preferably at least also or only upward, at least while they are connected to the at least one vacuum chamber, and/or with the suctioning action thereof preferably being directed at least also or only downward. The sheets 02 are then preferably transported lying flat by the suction transport means.

The sheet processing machine 01 is preferably a sheet processing machine 01 having at least one shaping device 900 and at least one sheet delivery unit 1000 situated downstream of the at least one shaping device 900 along a transport path provided for the transport of sheets 02. The at least one shaping device 900 is preferably configured as at least one rotary die-cutting device 900. For example, only one shaping device 900 and/or rotary die-cutting device 900 is provided. The at least one shaping device 900 preferably has at least one and more preferably only one shaping point 909, which is formed by at least one and more preferably only one plate cylinder 901, in particular configured as a die cylinder 901, on the one hand, and at least one counterpressure cylinder 902 on the other. The shaping point 909 is preferably the region in which the respective plate cylinder 901 and the respective counterpressure cylinder 902 are closest to one another. The at least one shaping point 909 is preferably configured as at least one die-cutting point 909 and/or as at least one transport means 909 and/or as at least one shaping transport means 909 and/or as at least one die-cutting transport means 909. Alternatively or additionally, the sheet processing machine 01 is preferably characterized in that the plate cylinder 901 of the shaping device 900, configured in particular as a die cylinder 901, is situated above the counterpressure cylinder 902 that cooperates with it. This means, in particular, that the axis of rotation of said plate cylinder 901, which is configured in particular as a die cylinder 901, is situated at a greater height than the axis of rotation of the counterpressure cylinder 902 that cooperates with it, in particular directly.

Alternatively or additionally, the sheet processing machine 01 is preferably characterized in that at least one separation device 903 for removing scrap pieces from sheets 02 is arranged downstream of the at least one shaping point 909 along the transport path provided for the transport of sheets 02. The at least one separation device 903 is thus used in particular for separating those parts of the sheet 02 that are to be further treated as sheets 02 and optionally further processed from such scrap pieces, in particular former parts of the sheet 02 that have already been fully or partially detached from the sheet 02 and are to be removed from the sheet 02. Such scrap pieces are created, for example, in a die-cutting process and/or are produced, for example, at the at least one shaping point 909. The at least one separation device 903 is configured as a separation unit 903 and/or as a separation module 903, for example. Alternatively, the at least one separation device 903 is a component of another unit 900 or module 900, in particular of the at least one shaping unit 900 or shaping module 900. In the foregoing and in the following, the term sheet 02 refers in particular both to sheets 02 that have not yet been processed by means of the at least one shaping device 900 and to sheets 02 that have already been processed by means of the at least one shaping device 900 and/or by means of the at least one separation device 903 and in said processing may have been altered in terms of their shape and/or their mass.

The at least one separation device 903 preferably has at least one separation transport means 904, in particular for transporting sheets 02. The at least one separation transport means 904 preferably serves to transport respective sheets 02 along the transport path provided for the transport of sheets 02 and/or in the direction of transport T while scrap pieces are removed from the respective sheets 02. The scrap pieces are preferably transported in a respective direction, at least one component of which is oriented orthogonally to the direction of transport T, for example vertically downward. Preferably, at least the force of gravity is also used to remove such scrap pieces from the respective sheets 02. Thus, it is preferably necessary only to apply a force that will separate the respective scrap piece from the respective sheet 02 and the respective scrap piece is then carried away downward by gravity.

Preferably, only one separation transport means 904 is arranged along the transport path provided for the transport of sheets 02. Alternatively, multiple differently configured separation transport means 904, for example, are arranged along the transport path provided for the transport of sheets 02. Alternatively or additionally, the sheet processing machine 01 is preferably characterized in that the at least one separation transport means 904 is configured to act and/or to be capable of acting on sheets 02 both from above and from below. This enables sheets 02 to be transported with sufficient accuracy along the transport path provided for the transport of sheets 02 despite the action of the at least one separation device 903. Alternatively or additionally, the sheet processing machine 01 is preferably characterized in that the at least one separation transport means 904 has multiple upper separation transport belts 907 arranged side by side and spaced apart from one another with respect to a transverse direction A and/or multiple lower separation transport belts 908 arranged side by side and spaced apart from one another with respect to a transverse direction A. Separation transport belts 907; 908 are configured, for example, as endless and/or circulating belts, which further preferably have a relatively small measurement in the transverse direction A, for example less than 5 cm, preferably less than 2 cm, and more preferably less than 1 cm. The distances between respective adjacent separation transport belts 907; 908 are preferably relatively large, for example at least 2 cm, more preferably at least 5 cm, even more preferably at least 10 cm, and more preferably still at least 20 cm. This allows scrap pieces to be moved downward and/or upward between the separation transport belts 907; 908, in particular to drop through.

Alternatively or additionally, the sheet processing machine 01 is characterized, for example, in that at least one roller nip is used as the separation transport means 904. In that case, scrap pieces can be moved downward and/or upward, and more particularly can drop through, between the respective roller nip and another transport means, for example upstream or downstream of the respective roller nip. At least one additional roller nip and/or at least one separation transport belt 907; 908, for example, can be provided as such a further transport means. Alternatively or additionally, the sheet processing machine 01 is preferably characterized in that the at least one separation transport means 904 is different from any suction transport means, i.e. is not configured as a suction transport means.

Alternatively or additionally, the sheet processing machine 01 is preferably characterized in that the at least one separation device 903 is configured as at least one jogging device 903 and/or in that the at least one separation device 903 has at least one jogging drive 911. The at least one jogging drive 911 can preferably be used to deflect at least one separation transport belt 907; 908 orthogonally to its localized transfer direction. A localized transfer direction in this context is understood as the direction in which a respective element of the respective separation transport belt 907; 908 is moved based on a circulating movement of the respective separation transport belt 907; 908, in particular apart from any superimposed deflection movements. The at least one jogging drive 911 thus preferably serves to jog the respective sheet 02, in particular by movements in directions orthogonally to the direction of transport T. Such movements are necessary only in the case of a small deflection, for example. The at least one jogging drive 911 is arranged to act and/or to be capable of acting, for example, directly or indirectly on the at least one separation transport means 904 and/or at least one separation transport belt 907; 908, for example via at least one impact shaft. The at least one jogging drive 911 is arranged to act or to be capable of acting, for example, directly or indirectly on at least one deflecting means and/or at least one guide means of at least one separation transport belt 907; 908. At least one electric and/or at least one pneumatic and/or at least one hydraulic and/or at least one magnetic drive is provided as the jogging drive 911, for example. Alternatively or additionally, the at least one separation device 903 has at least one separation fan, for example, which further preferably serves to remove scrap pieces from the respective sheets 02 by means of at least one at least intermittently activated flow of gas.

Alternatively or additionally, the sheet processing machine 01 is preferably characterized in that the at least one separation transport means 904 has at least one transport drive 912, by means of which at least one component of the at least one separation transport means 904 can be driven in circulation, in particular in at least one respective localized transfer direction. The at least one transport drive 912 of the at least one separation transport means 904, and particularly the drive controller thereof, is preferably connected to the machine controller of the processing machine 01 and/or to the electronic master axis, in particular via the BUS system.

Alternatively or additionally, the sheet processing machine 01 is preferably characterized in that the at least one separation device 903 has at least one collecting device for scrap pieces, arranged below the transport path provided for the transport of sheets 02. The collecting device is configured, for example, as a container and/or as a shredding device and/or as a driven removal device, for example as a transport belt.

Alternatively or additionally, the sheet processing machine 01 is preferably characterized in that at least one transport means 09; 906 configured as a selective transport means 09; 906 is arranged along the transport path provided for the transport of sheets 02, in particular downstream of the at least one separation transport means 904 along the transport path provided for the transport of sheets 02. The at least one transport means 09; 906 configured as a selective transport means 09; 906 is preferably arranged following the at least one separation transport means 904 along the transport path provided for the transport of sheets 02, in particular directly following the at least one separation transport means 904. A selective transport means 09; 906 in this context is understood in particular as a transport means 09; 906 that is configured as transport and/or as capable of transporting only selected objects, for example exclusively sheets 02 and/or no scrap pieces. At least one position and/or at least one dimension of the respective object, in particular with respect to the transverse direction A, is used as a distinguishing criterion. Preferably, the at least one selective transport means 09; 906 is configured as at least one upper suction transport means 09; 906 for the hanging transport of sheets 02, more preferably as at least one exclusively upper suction transport means 09; 906 and/or for an exclusively hanging transport of sheets 02. Any scrap pieces can then also drop downward downstream of the at least one separation transport means 904 and can be moved away from the sheets 02 without interfering with subsequent processes.

Alternatively or additionally, the sheet processing machine 01 is preferably characterized in that the transport path provided for the transport of sheets 02 is at least substantially flat and more preferably completely flat downstream of the at least one separation transport means 904 to a point above a delivery pile carrier 48 of the sheet delivery unit 100.

Alternatively or additionally, the sheet processing machine 01 is preferably characterized in that at least one transport means 07 configured as a sheet decelerating means 07 is arranged downstream of the at least one selective transport means 906 along the transport path provided for the transport of sheets 02 and more preferably is arranged at least partially and more preferably fully above a delivery pile carrier 48 of the sheet delivery unit 1000. The at least one sheet decelerating means serves in particular to decelerate sheets 02 before they are deposited onto a delivery pile 28.

Alternatively or additionally, the sheet processing machine 01 is preferably characterized in that at least one sheet diverter 49 for channeling sheets 02 onto a transport path that bypasses the at least one sheet decelerating means 07 is arranged between the at least one separation device 903 and the at least one sheet decelerating means 07 along the transport path provided for the transport of sheets 02. The at least one sheet diverter 49 serves, for example, to channel at least one sample sheet to be inspected and/or at least one scrap sheet. The at least one sheet diverter 49 has at least one deflecting element, for example, more preferably multiple deflecting elements, which are arranged side by side with respect to the transverse direction A. The deflecting elements are preferably arranged in such a way that they can be switched, in particular pneumatically, between a pass-through position and a deflecting position. When at least one deflecting element is in the pass-through position, at least one respective sheet 02 is preferably forwarded along the transport path provided for the transport of sheets 02 to the at least one sheet decelerating means 07 and or the delivery pile carrier 48. When at least one deflecting element is in the deflecting position, at least one respective sheet 02 is preferably forwarded to the transport path that bypasses the at least one sheet decelerating means 07 and/or to a reject delivery unit 51. At least one guide 52, in particular at least one guide plate 52, is preferably provided, by means of which the forwarding to the transport path that bypasses the at least one sheet decelerating means 07 and/or to the reject delivery unit 51 is preferably carried out. For example, sheets are channeled by means of the at least one deflecting element between two guides 52, which initially act as upper and lower guides 52 and which, as a result of their curvature, become forward and rear guides 52 further along the transport path. The at least one deflecting element is arranged, for example, such that in its deflecting position, it is arranged between at least two transport conveyors and/or transport belts of the at least one selective transport means 09; 906 in the transverse direction.

The respective at least one selective transport means 09; 906 preferably has at least two and more preferably at least five transport belts arranged side by side in the transverse direction A and/or spaced apart in the transverse direction A. For example, multiple suction belts are provided in each case as the at least one selective transport means 09; 906. The width of each of these suction belts is preferably at least 10 mm, for example, more preferably at least 20 mm, even more preferably at least 50 mm, and is preferably no more than 200 mm, more preferably no more than 100 mm, and even more preferably no more than 80 mm. In all, these suction belts preferably cover at least 10%, more preferably at least 20%, and even more preferably at least 25% of the working width of the sheet processing machine 01, and independently of this preferably cover no more than 50%, more preferably no more than 40%, and even more preferably no more than 35% of the working width of the sheet processing machine.

Alternatively or additionally, the sheet processing machine 01 is preferably characterized in that two selective transport means 09; 906 are arranged one behind the other along the transport path provided for the transport of sheets 02 and/or in the direction of transport T. A first of these at least two selective transport means 09; 906 with respect to the transport path provided for the transport of sheets 02 and/or the direction of transport T, in particular, is configured, for example, as an output transport means 906 of the at least one shaping device 900. The at least one output transport means 906 of the at least one shaping device 900 serves, for example, to ensure that only sheets 02 without scrap pieces are passed on. A second and/or last of these at least two selective transport means 09; 906 with respect to the transport path provided for the transport of sheets 02 and/or the direction of transport T, in particular, is configured as sheet transfer means 09. The at least one sheet transfer means 09 serves, for example, to forward sheets 02 that are intended for the delivery pile 28. The at least one sheet transfer means 09 is assigned to the sheet delivery unit 1000, for example. The operating zone of the at least one sheet diverter 49 is located, for example, at a point along the transport path provided for the transport of sheets 02 that, as viewed in the direction of transport T, is spaced no more than 100 cm, more preferably no more than 50 cm, and even more preferably no more than 20 cm from both the at least one output transport means 906 and the at least one sheet transfer means 09. This allows a modular structure to be implemented in which the at least one output transport means 906 can be adapted to respective machine conditions while the at least one sheet transfer means 09 has a standardized configuration. The at least one reject delivery unit 51 and/or the at least one guide 52 is preferably located beneath the at least one sheet transfer means 09.

Each of the at least two selective transport means 09; 906 is preferably configured as a respective suction transport means 09; 906. The at least one selective transport means 09; 906 preferably has at least its own one drive 21; 913, which more preferably is configured, in particular, as a closed loop position-controlled electric motor 21; 913. More preferably, each of the at least two selective transport means 09; 906 has its own drive 21; 913, which more preferably is configured, in particular, as a closed loop position-controlled electric motor 21; 913. In particular, the at least one output transport means 906 preferably has at least one output drive 953, which more preferably is configured, in particular, as a closed loop position-controlled electric motor 953. The at least one output transport means 906, and particularly the drive controller thereof, is preferably connected to the machine controller of the processing machine 01 and/or to the electronic master axis, in particular via the BUS system.

Alternatively or additionally, the sheet processing machine 01 is preferably characterized in that at least one imbricating device 46 is arranged between the at least one selective transport means 906 on the one hand and the at least one sheet decelerating device 07 on the other along the transport path provided for the transport of sheets 02. Alternatively or additionally, the sheet processing machine 01 is preferably characterized in that the at least one imbricating device 46 is arranged between the at least one sheet diverter 49 on the one hand and the at least one sheet decelerating device 07 on the other along the transport path provided for the transport of sheets 02. Alternatively or additionally, the sheet processing machine 01 is preferably characterized in that it has at least one transport means 08 configured as an upper suction transport means 08 and/or as a sheet infeed means 08. The at least one upper suction transport means 08 of the at least one imbricating device 46 is further preferably configured as a passively driven suction transport means 08 and/or as a sliding suction device 08.

Alternatively or additionally, the sheet processing machine 01 is preferably characterized in that the sheet delivery unit 1000 has at least one forward pile limiter 04 and/or in that a delivery pile area is delimited at least by the at least one rear sheet stop 03 and the at least one forward pile limiter 04 and/or in that the sheet delivery unit 1000 has at least one upper sheet transport system 06 configured for the hanging transport of sheets 02 and comprising the at least one imbricating device 46 and/or in that the at least one imbricating device 46 produces imbrication for an imbricated, hanging transport of at least two sheets 02 at at least one point located above the delivery pile area as viewed in the vertical direction V.

Alternatively or additionally, the sheet processing machine 01 is preferably characterized in that the at least one upper sheet transport system 06 configured for the hanging transport of sheets 02 has at least one sheet infeed means 08 configured as an upper suction transport means 08 and at least one sheet decelerating means 07 configured as an upper suction transport means 07 and/or in that the at least one sheet infeed means 08 is arranged at least partially upstream of the at least one sheet decelerating means 07 with respect to the direction of transport T and/or in that the at least one sheet infeed means 08 is arranged at least partially upstream of the at least one forward pile limiter 04 with respect to the direction of transport T and/or extends beyond the at least one forward pile limiter 04 and/or in that at least one downwardly acting, activatable displacement element 12 is arranged in the region of the at least one sheet infeed means 08 on the transport path provided for the transport of sheets 02 and/or with respect to the direction of transport T and/or in that at least one downwardly acting, activatable displacement element 12 is positioned such that its displacement region overlaps at least partially with respect to the direction of transport T with a transporting section of the transport path provided for the transport of sheets, determined by the at least one sheet infeed means 08.

Alternatively or additionally, the sheet processing machine 01 is preferably characterized in that the at least one sheet decelerating means 07 is arranged entirely downstream of the at least one forward pile limiter 04 on the transport path provided for the transport of sheets 02 and/or with respect to the direction of transport T. This preferably ensures that a succeeding sheet 02 will not be negatively influenced by the at least one sheet decelerating means 07. Alternatively or additionally, the sheet processing machine 01 is preferably characterized in that the at least one sheet decelerating means 07 is the next transport means 07 following the at least one sheet infeed means 08 with respect to the transport path provided for the transport of sheets 02 and/or the direction of transport T.

Alternatively or additionally, the sheet processing machine 01 is preferably characterized in that transport means 906; 07; 08; 09 are arranged extending continuously from a point downstream of the at least one separation transport means 904 to a point above a delivery pile carrier 48 of the sheet delivery unit 100 along the transport path provided for the transport of sheets 02, said transport means at least also being configured as transport means 906; 07; 08; 09 that act as upper suction transport means 906; 07; 08; 09 and/or as transport means 906; 07; 08; 09 for sheets 02 that are configured for a hanging transport of sheets 02. An arrangement that has smaller gaps between such transport means 906; 07; 08; 09 is also understood in this context to be a continuous arrangement, provided no transport means 906; 07; 08; 09 that act solely from underneath are arranged therebetween. Such gaps are preferably smaller than 50 cm, more preferably smaller than 20 cm, even more preferably smaller than 10 cm, and more preferably still smaller than 5 cm.

Alternatively or additionally, the sheet processing machine 01 is preferably characterized in that transport means 906; 07; 08; 09 configured exclusively as upper suction transport means 906; 07; 08; 09 and/or transport means 906; 07; 08; 09 for sheets 02 that are provided for a hanging transport of sheets 02 are arranged extending from a point downstream of the at least one separation transport means 904 to a point above the delivery pile carrier 48 of the sheet delivery unit 100 along the transport path provided for the transport of sheets 02.

For example, at least one transport means 909 configured as a shaping point 909 and acting and/or capable of acting on sheets 02 from above and below is arranged along the transport path provided for the transport of sheets 02. For example, at least one transport means 904 configured as a separation transport means 904 and preferably acting and/or capable of acting on sheets 02 from above and below is arranged downstream of the at least one shaping point 909 along the transport path provided for the transport of sheets 02. For example, at least one transport means 906 configured as an output transport means 906 and preferably intended for the hanging transport of sheets 02 and/or acting and/or capable of acting on sheets 02 only from above is arranged downstream of the at least one separation transport means 904 along the transport path provided for the transport of sheets 02. A transfer point for the hanging transfer of sheets 02 to a subsequent upper suction transport means 09 is preferably located at the end of the at least one output transport means 906 along the transport path provided for the transport of sheets 02.

For example, at least one transport means 09 configured as a sheet transfer means 09 and preferably intended for the hanging transport of sheets 02, and/or acting and/or capable of acting on sheets 02 only from above is arranged downstream of the at least one output transport means 906 along the transport path provided for the transport of sheets 02. For example, at least one transport means 08 configured as a sheet infeed means 08 and preferably intended for the hanging transport of sheets 02, and/or acting and/or capable of acting on sheets 02 only from above is arranged downstream of the at least one sheet transfer means 09 along the transport path provided for the transport of sheets 02. For example, at least one transport means 07 configured as a sheet decelerating means 07 and preferably intended for the hanging transport of sheets 02, and/or acting and/or capable of acting on sheets 02 only from above is arranged downstream of the at least one sheet infeed means 08 along the transport path provided for the transport of sheets 02.

The sheet delivery unit 1000 is preferably a sheet delivery unit 1000 of a sheet processing machine 01. The sheet delivery unit 1000 preferably has at least one rear sheet stop 03, also referred to as a rear pile limiter 03. The sheet delivery unit 1000 preferably has at least one forward pile limiter 04, also referred to as a forward sheet stop 04. The direction of transport T is preferably a horizontal direction T that is oriented from the forward pile limiter 04 toward the rear sheet stop 03.

Alternatively or additionally, the sheet delivery unit 1000 is preferably characterized in that the sheet delivery unit 1000 has at least one sheet transport system 06 configured in particular for the hanging transport of sheets 02, more preferably configured as an upper sheet transport system 06. The upper sheet transport system 06, in particular, preferably has at least one sheet infeed means 08 configured as an upper suction transport means 08. The upper sheet transport system 06, in particular, preferably comprises the at least one sheet decelerating means 07 configured as an upper suction transport means 07. The at least one sheet infeed means 08 is preferably arranged at least partially upstream of the at least one sheet decelerating means 07 with respect to the direction of transport T. In particular, the at least one sheet decelerating means 07 is arranged at least partially downstream of the at least one sheet infeed means 08 with respect to the direction of transport T.

Alternatively or additionally, the sheet delivery unit 1000 is preferably characterized in that the at least one sheet infeed means 08 and the at least one sheet decelerating means 07 are arranged such that the at least one sheet infeed means 08 and the at least one sheet decelerating means 07 overlap partially with respect to the direction of transport T. This means, in particular, that in this case, at least one component of the at least one sheet infeed means 08 and at least one component of the at least one sheet decelerating means 07 are preferably arranged side by side in the transverse direction A. In a possible refinement, one component of a transport surface 22 of the at least one sheet decelerating means 07 is arranged in the transverse direction A next to a component of a transport surface 23 of the at least one sheet infeed means 08.

At least one sheet transfer means 09 is preferably arranged at least partially upstream of the at least one sheet infeed means 08 and more preferably entirely upstream of the at least one sheet decelerating means 07 with respect to the direction of transport T and/or along the transport path provided for the transport of sheets. The at least one sheet transfer means 09 preferably serves to feed sheets 02 coming from a region of the processing machine 01 that is further upstream to the sheet delivery unit 1000 and/or to the at least one sheet infeed means 08. The at least one sheet transfer means 09 is configured, for example, as a component of the sheet delivery unit 1000 or as a component of another unit 600; 700; 900, for example as a component of the at least one shaping unit 900 or die-cutting unit 900 or as a component of an application unit 600 or as a component of a transport unit 700.

The at least one sheet transfer means 09 is preferably configured as at least one upper suction transport means 09, more preferably as at least one suction belt 09. The at least one sheet transfer means 09 preferably has a plurality of transport belts 38 arranged side by side in the transverse direction A, each having intake openings 36. The transport belts 38 of the at least one sheet transfer means 09 preferably establish a transport surface 24 of the at least one sheet transfer means 09. The individual transport belts 38 of the at least one sheet transfer means 09 are preferably arranged spaced apart from one another. The spaces situated therebetween preferably provide space for the at least one sheet transfer means 09 and the at least one sheet infeed means 08 to be arranged partially overlapping with respect to the direction of transport T.

Preferably, at least one sheet transfer means 09 configured as an upper suction transport means 09 is arranged at least partially upstream of the at least one sheet infeed means 08 and more preferably entirely upstream of the at least one sheet decelerating means 07 with respect to the direction of transport T. In particular, the at least one sheet infeed means 08 is preferably arranged at least partially downstream of the at least one sheet transfer means 09 with respect to the direction of transport T.

At least one transfer means drive 21 is preferably provided, by means of which the at least one sheet transfer means 09 can be driven, in particular with respect to movements of the transport surface 24 of the at least one sheet transfer means 09, at least in the direction of transport T. The at least one transfer means drive 21 is preferably configured in particular as a closed loop position-controlled electric motor 21. The at least one transfer means drive 21, and particularly the drive controller thereof, is preferably connected to the machine controller of the processing machine 01 and/or to the electronic master axis, in particular via the BUS system.

The at least one sheet transfer means 09 and the at least one sheet infeed means 08 preferably overlap partially with respect to the direction of transport T. This means, in particular, that in this case, at least one component of the at least one sheet transfer means 09 and at least one component of the at least one sheet infeed means 08 are preferably arranged side by side in the transverse direction A. In a possible refinement, one component of the transport surface 24 of the at least one sheet transfer means 09 is arranged in the transverse direction A next to a component of a transport surface 23 of the at least one sheet infeed means 08.

Alternatively or additionally, the sheet delivery unit 1000 is preferably characterized in that the at least one sheet infeed means 08 begins upstream of the at least one forward pile limiter 04 and also ends upstream of the at least one forward pile limiter 04. Alternatively or additionally, the sheet delivery unit 1000 is preferably characterized in that the at least one sheet infeed means 08 extends in particular beyond the at least one forward pile limiter 04 with respect to the direction of transport T, i.e. begins in particular upstream of the at least one forward pile limiter 04 and ends downstream of the at least one forward pile limiter 04. Preferably, the sheets 02 are held, at least temporarily, by means of the at least one sheet infeed means 08 in an area located vertically above the at least one forward pile limiter 04, in particular are held overhead, in particular while they are being transported. The at least one sheet infeed means 08 is preferably configured as a roller suction system 08 and more preferably has a plurality of transport rollers 26. The at least one roller suction system 08 has multiple shafts, for example, each of which can be rotated about a respective axis, with each said axis extending in the transverse direction A. On each of these shafts, multiple transport rollers 26 are arranged side by side, for example, in particular spaced apart from one another in the transverse direction A. Preferably, however, the at least one sheet infeed means 08 has multiple individual guide elements 39, each of which has multiple transport rollers 26 that are arranged one behind the other in the direction of transport T and more preferably can be turned and/or rotated independently of one another. Each such guide element 39 has only one row of such transport rollers 26, for example. The transport rollers 26 are preferably mounted in a respective housing of the respective guide element 39, which further preferably also forms a corresponding vacuum chamber. The respective guide elements 39 are arranged spaced apart from one another in the transverse direction A, for example. The guide elements 39 are arranged, for example, at least partially, for example at one of their ends, in a respective space between transport belts 38 of the at least one sheet transfer means 09 and at their other end in a respective space between transport belts 37 of the at least one sheet decelerating means 07.

Alternatively or additionally, the sheet delivery unit 1000 is preferably characterized in that the at least one sheet infeed means 08 is configured as a passively driven suction transport means 08, in particular with respect to a transport of sheets in the direction of transport T and/or with respect to its transport surface 23. A passively driven suction transport means 08 in this context is understood in particular as a suction transport means 08 that does not have its own drive for moving the sheets 02 forward, and instead has at least one freely movable, in particular freely rotatable transport surface 23, which is set in motion solely by way of contact with a sheet 02. Although the passively driven suction transport means 08 uses a vacuum to hold sheets 02 on its transport surface 23, it preferably has no active influence on their movement in the direction of transport T.

The at least one sheet infeed means 08 configured as a passively driven suction transport means 08 and as a roller suction system 08 offers the advantage that parts of at least two sheets 02 can be transported with it at the same time but at different speeds. A vacuum preferably exists in the sheet infeed means 08 continuously during operation of the sheet processing machine 01.

Alternatively or additionally, the sheet delivery unit 1000 is preferably characterized in that at least one decelerating means drive 19 is provided, by means of which the at least one sheet decelerating means 07 can be driven. The at least one decelerating means drive 19 is preferably configured, in particular, as a closed loop position-controlled electric motor 19. The at least one decelerating means drive 19, and particularly the drive controller thereof, is preferably connected to the machine controller of the processing machine 01 and/or to the electronic master axis, in particular via the BUS system. The at least one sheet decelerating means 07 can be used to decelerate sheets 02, for example from a transfer speed and/or to a final speed. The transfer speed is preferably a speed at which sheets 02 are fed to the sheet delivery unit 1000. The final speed is preferably a speed at which sheets 02 are transported, with respect to the transport path provided for the transport of sheets 02 and/or to the direction of transport T, at the moment in which they are detached from the at least one sheet decelerating means 07. The final speed is preferably zero. A downward movement for depositing the respective sheets 02 on a delivery pile 28 is not factored into this speed.

The at least one sheet decelerating means 07 is preferably configured as at least one suction belt 07. The at least one sheet decelerating means 07 preferably has a plurality of transport belts 37 arranged side by side in the transverse direction A, each having intake openings 36. The transport belts 37 of the at least one sheet decelerating means 07 preferably establish the transport surface 22 of the at least one sheet decelerating means 07. The individual transport belts 37 of the at least one sheet decelerating means 07 are preferably arranged spaced apart from one another. The spaces situated therebetween provide space for at least one dropping means 32, for example, and preferably for one dropping means each. The spaces situated therebetween alternatively or additionally provide space for the at least one sheet decelerating means 07 and the at least one sheet infeed means 08 to be arranged partially overlapping with respect to the direction of transport T.

Alternatively or additionally, the sheet delivery unit 1000 is preferably characterized in that the sheet delivery unit 1000 has at least one dropping means 32, which can be moved between at least one standby position and at least one dropping position, and in that in its at least one standby position, the at least one dropping means 32 is positioned fully above that part of the transport surface 22 of the at least one sheet decelerating means 07 that contributes to establishing the transport path provided for the transport of sheets 02, and in that in its at least one dropping position, the at least one dropping means 32 protrudes at least partially downward to a point below said part of the transport surface 22 of the at least one sheet decelerating means 07. The at least one dropping means 32 serves in particular to press sheet 02 downward in a targeted, in particular controlled and/or regulated manner, and/or to release it from the at least one sheet decelerating means 07, in particular so that the respective sheet 02 can be deposited onto the delivery pile 28. At least one dropping drive 33; 34 is preferably provided, by means of which at least one dropping means 32 can be moved. The at least one dropping drive 33; 34 is preferably configured, in particular, as a closed loop position-controlled electric motor 33; 34. Alternatively or additionally, at least one hydraulic and/or at least one pneumatic dropping drive can also be provided. Alternatively or additionally, at least one blower device can also be provided for effecting and/or supporting the detachment of the sheets 02 from the at least one sheet decelerating means 07. The at least one dropping drive 33; 34, and particularly the drive controller thereof, is preferably connected to the machine controller of the processing machine 01 and/or to the electronic master axis, in particular via the BUS system.

The at least one dropping means 32 is preferably connected at a first connection point 41 to a first dropping drive 33, in particular via at least one first dropping gear mechanism 43. The first dropping gear mechanism 43 has, for example, at least one first dropping eccentric which is connected to the first dropping drive 33 and which is connected to the upper end of a first dropping connecting rod. At the lower end, the first dropping connecting rod is preferably connected to a first guide element, for example a first guide lever. This limits the degrees of freedom of movement of this lower end of the first dropping connecting rod. This lower end of the first dropping connecting rod is connected to the respective dropping means 32 at the first connection point 41, for example via at least one first suspension element. The at least one dropping means 32 is preferably connected at a second connection point 42 to a second dropping drive 34, in particular via a second dropping gear mechanism 44. The second dropping gear mechanism 44 has, for example, at least one second dropping eccentric, which is connected to the second dropping drive 34 and which is connected to an upper end of a second dropping connecting rod. At a lower end, the second dropping connecting rod is preferably connected to a second guide element, for example a second guide lever. This limits the degrees of freedom of movement of the lower second end of the second dropping connecting rod. This lower end of the second dropping connecting rod is connected to the respective dropping means 32 at the second connection point 42, for example via at least one second suspension element. The first connection point 41 is preferably located upstream of the second connection point 42 with respect to the direction of transport T.

Alternatively or additionally, the sheet delivery unit 1000 is preferably characterized in that the sheet delivery unit 1000 has at least one upper sheet transport system 06 configured for the hanging transport of sheets 02, having at least one imbricating device 46 for the imbricated, hanging transport of at least two sheets 02, in particular for the imbricated, hanging transport of at least two sheets 02, at least at one point located above at least one delivery pile carrier 48 and/or above a delivery pile 28 and/or above a delivery pile area, as viewed in the vertical direction V. The delivery pile area is preferably the area in which the respective delivery pile 28 is formed, in particular on the at least one delivery pile carrier 48, during operation of the sheet delivery unit 1000 and/or the sheet processing machine 01. The delivery pile area is preferably delimited, in particular with respect to the direction of transport T, at least by the at least one rear sheet stop 03 and the at least one forward pile limiter 04. The at least one delivery pile carrier 48 is, for example, a pallet and/or a component of the sheet delivery unit 1000 and/or of the sheet processing machine 01 that supports and/or is capable of supporting a pallet.

Alternatively or additionally, the sheet delivery unit 1000 is preferably characterized in that at least one displacement element 12 is provided, which acts downward, in particular is capable of acting downward on sheets 02. Said at least one displacement element 12 is preferably configured as activatable. The at least one displacement element 12 is also preferably configured as deactivatable. This enables the at least one displacement element 12 to be activated for each sheet 02 and then deactivated again. The at least one displacement element 12 is preferably located in the region of the at least one sheet infeed means 08, preferably with respect to the direction of transport T. The at least one displacement element 12 is preferably arranged such that its displacement region with respect to the direction of transport preferably overlaps at least partially with a transporting section of the transport path provided for the transport of sheets, said section being determined by the at least one sheet infeed means 08. Thus, the at least one displacement element 12 is preferably arranged, in particular, at least partially and more preferably entirely, with respect to the direction of transport T, at least at a point where at least a part of the transport surface 23 of the at least one sheet infeed means 08 is also arranged, with respect to the direction of transport T. More preferably, the at least one displacement element 12 is arranged at least partially and more preferably entirely, with respect to the direction of transport T, at least at a point that is located spaced apart from each transport surface 24 of the at least one sheet transfer means 09 and/or from each transport surface 22 of the at least one sheet decelerating means 07 with respect to the direction of transport T. Preferably, the one displacement element 12 is arranged at least partially and, for example, at least intermittently entirely upstream of the at least one forward pile limiter 04 with respect to the direction of transport T.

The at least one displacement element 12 preferably serves to displace a part of a respective, in particular leading sheet 02, in particular the trailing end 29 thereof. This opens up a space, which can then be occupied by a respective leading end 31 of a respective sheet 02 succeeding the respective leading sheet 02. The sheets 02 are thus arranged and transported at least temporarily in an imbricated state. The at least one displacement element 12 is preferably a component of the imbricating device 46. This allows the succeeding sheet 02 to move in the direction of transport T into a part of the transport path provided for the transport of sheets 02 in which the leading sheet 02 is still positioned with respect to the direction of transport T, in particular because its deceleration process has not yet been fully completed and/or because it is still attached to the at least one sheet decelerating means 07. This allows a more gentle deceleration of the sheets 02, for example, and/or a greater number of decelerated sheets 02 per unit of time to be realized.

The at least one displacement element 12 is preferably configured as at least one displacement member 12 and/or as at least one displacement opening 12. A respective displacement member 12 acts in particular on sheets 02 by being brought into contact with the respective sheet 02 and displacing it at least partially from its current position, in particular with at least one directional component that is oriented orthogonally to the direction of transport T. A respective displacement opening 12 acts, in particular, on sheets 02 in that at least one displacement fluid, in particular at least one gas or gas mixture, preferably air, is expelled from the respective displacement opening 12 and said at least one displacement fluid displaces the sheet 02 at least partially from its current position, in particular with at least one directional component that is oriented orthogonally to the direction of transport T. Alternatively or additionally, the sheet delivery unit 1000 is preferably characterized in that the at least one displacement element 12 is configured as at least one displacement opening 12 configured to emit a displacement fluid, and more preferably in that said displacement fluid is embodied as a gas and/or gas mixture and/or air. The at least one displacement opening 12 preferably is and/or can be connected to at least one compressed air source. A displacement element 12 configured as at least one displacement opening 12 is suitable, for example, for displacing sheets 02 that are particularly vulnerable in terms of their material and/or their surface as gently as possible.

A displacement region is preferably the specific region in which the at least one displacement element 12 influences and/or is capable of influencing the position of a respective sheet 02. In the case of a displacement element 12 configured as a displacement member 12, the displacement region is, for example, the spatial area that, in particular at each of its spatial elements, is and/or can be occupied at least intermittently by the at least one displacement element 12 and also is and/or can be occupied at least intermittently, in particular at other instants, by at least one sheet 02. In the case of a displacement element 12 configured as a displacement opening 12, the displacement region is, for example, the spatial area into which the displacement fluid is blown, at least intermittently, and which is and/or can be occupied at least intermittently, in particular at other instants, by at least one sheet 02.

Alternatively or additionally, the sheet delivery unit 1000 is preferably characterized in that the at least one displacement element 12 is configured as at least one displacement member 12, the position of which can preferably be changed between at least one pass-through position and at least one displacement position, preferably at least by means of at least one displacement drive 27. A displacement element 12 configured as at least one displacement member 12 is suitable, for example, for displacing sheets 02 as precisely as possible and for influencing succeeding sheets 02 as little as possible, particularly if contact with succeeding sheets 02 is prevented.

Figure 8A:
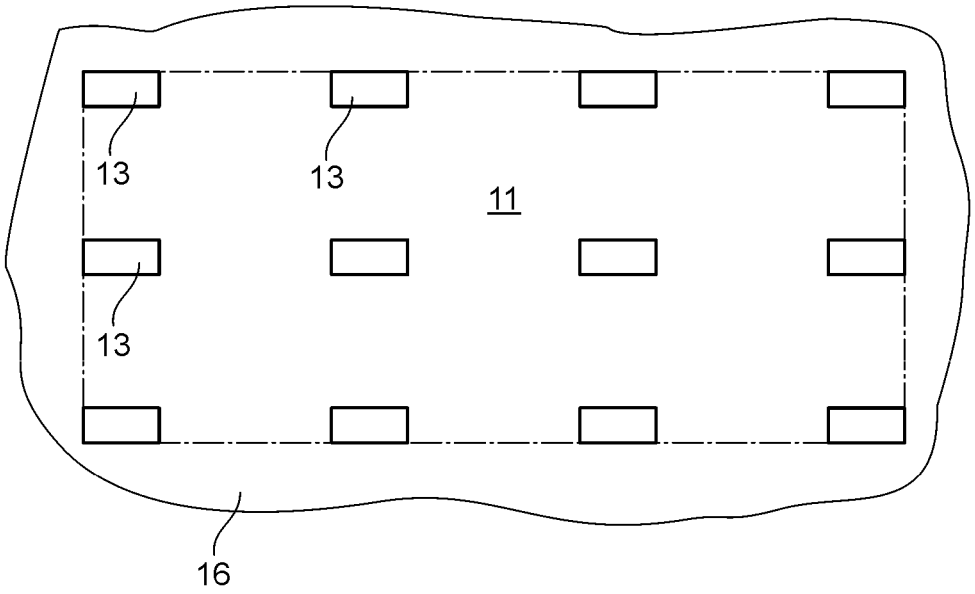
FIG. 8*a* a diagram illustrating a respective contact region and a contact surface of a sheet infeed means.
Figure 8B:
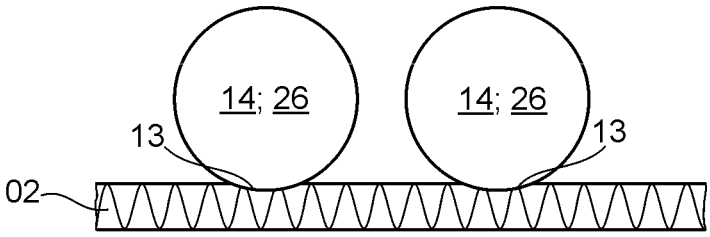
FIG. 8*b* a diagram illustrating a respective contact region and a contact surface of a sheet infeed means.

A respective contact region 13 of the at least one sheet infeed means 08 is preferably the respective, in particular flat region 13 in which contact is provided between a respective, in particular movable component 14 of the at least one sheet infeed means 08 on one hand and a respective sheet 02 to be transported on the other. Such a respective component 14 is, for example, a respective transport roller 26 of the at least one sheet infeed means 08. A contact surface 16 is preferably understood as a single coherent surface 16 that comprises all the contact regions 13 of the at least one sheet infeed means 08. In mathematical terms, a single coherent surface is one in which every closed path located exclusively within this area can be focused at one point. A reference surface 11 is preferably defined as the contact surface 16, out of all contact surfaces 16, that has both the shortest boundary line and the smallest surface area. A boundary line in this context is the line that delimits said contact surface 16. (This is depicted schematically by way of example in FIGS. 8*a* and 8*b*.) Alternatively or additionally, the sheet delivery unit 1000 is preferably characterized in that in its at least one displacement position, the at least one displacement member 12 protrudes downward through the reference surface 11 in a displacement region, and more preferably in that in its at least one pass-through position, the at least one displacement member 12 is positioned fully above the reference surface 11. Alternatively or additionally, the sheet delivery unit 1000 is preferably characterized in that the contact surface 16 lies at least substantially and more preferably fully within a contact plane and/or in that the reference surface 11 lies at least substantially and more preferably fully within a reference plane. The displacement axis 17 is preferably located above a reference surface 11.

Alternatively or additionally, the sheet delivery unit 1000 is preferably characterized in that the at least one displacement member 12, in at least one displacement position in a displacement region, protrudes downward by at least 1 mm, more preferably at least 2 mm, even more preferably at least 5 mm, even more preferably at least 9 mm, even more preferably at least 11 mm, and more preferably still at least 14 mm through the reference surface 11. The displacement region is preferably the spatial area that lies below the reference surface 11 and is occupied by the at least one displacement member 12.

Alternatively or additionally, the sheet delivery unit 1000 is preferably characterized in that the at least one displacement member 12, in at least one displacement position, protrudes downward through the reference surface 11 in the displacement region by at least 100%, more preferably at least 120%, and even more preferably at least 150% of the maximum thickness of sheets 02 that can be processed by the sheet delivery unit 1000.

Alternatively or additionally, the sheet delivery unit 1000 is preferably characterized in that, at least in at least one displacement position with respect to the direction of transport T, the at least one displacement member 12 is arranged at least partially upstream of the at least one forward pile limiter 04, more preferably at least 5 mm upstream of it, even more preferably at least 10 mm upstream of it, and more preferably still at least 15 mm upstream of it. Alternatively or additionally, the sheet delivery unit 1000 is preferably characterized in that the at least one displacement axis 17 is arranged, with respect to the direction of transport T, at least partially upstream of the at least one forward pile limiter 04, more preferably at least 5 mm upstream of it, even more preferably at least 10 mm upstream of it, and more preferably still at least 15 mm upstream of it. Alternatively or additionally, the sheet delivery unit 1000 is preferably characterized in that, at least in at least one displacement position, the at least one displacement member 12 is arranged, with respect to the direction of transport T, at least partially upstream of the at least one sheet decelerating means 07, more preferably at least 2 cm upstream of it, even more preferably at least 3 cm upstream of it, even more preferably at least 5 cm upstream of it, and more preferably still at least 10 cm upstream of it, and independently thereof is preferably arranged no more than 50 cm upstream of it and more preferably no more than 25 cm upstream of it. Alternatively or additionally, the sheet delivery unit 1000 is preferably characterized in that the at least one displacement axis 17 is arranged at least partially upstream of the at least one sheet decelerating means 07 with respect to the direction of transport T, more preferably at least 2 cm upstream of it, even more preferably at least 3 cm upstream of it, even more preferably at least 5 cm upstream of it, and more preferably still at least 10 cm upstream of it, and independently thereof, is preferably arranged no more than 50 cm upstream of it and more preferably no more than 25 cm upstream of it. Alternatively or additionally, the sheet delivery unit 1000 is preferably characterized in that the position of the at least one displacement element 12 and/or of the at least one displacement axis 17 with respect to the direction of transport T can be modified. This way allows the system to be adjusted for different sheet lengths 02.

Alternatively or additionally, the sheet delivery unit 1000 is preferably characterized in that the at least one displacement element 12 has at least one contact roller 18 and more preferably at least one inherently damped contact roller 18. The inherently damped contact roller 18 preferably has an inner ring, an outer ring, and a number of spokes, the spokes more preferably each extending in a spiral shape from the inner ring to the outer ring. The at least one contact roller 18 is preferably configured as a freely rotatable contact roller 18. The at least one contact roller 18 preferably serves to enable rolling contact between a respective sheet 02 on the one hand and the at least one displacement member 12 on the other.

The at least one imbricating device 46 preferably comprises the at least one displacement element 12. The at least one imbricating device 46 more preferably also comprises the at least one displacement drive 27 and/or the at least one contact roller 18 and/or the at least one sheet infeed means 08.

The at least one displacement element 12 is preferably configured as at least one displacement lever 12, which is arranged such that it can be turned, in particular pivoted or more preferably rotated, about a displacement axis 17, in particular by means of the at least one displacement drive 27. The at least one displacement drive 27 is preferably configured, in particular, as a closed loop position-controlled electric motor 27. The at least one displacement drive 27, and particularly the drive controller thereof, is preferably connected to the machine controller of the processing machine 01 and/or to the electronic master axis, in particular via the BUS system. This enables movement profiles of the at least one displacement member 12 that are particularly precise and/or matched to movements of the sheets 02 to be implemented.

The displacement axis 17 is preferably oriented parallel to the transverse direction A. Respective rotational movements of the at least one displacement member 12 about the displacement axis 17 are preferably carried out in a direction of rotation D. The direction of rotation D is preferably characterized in that rotational movements of components of the at least one displacement member 12 that rotate in the direction of rotation D and are located below the displacement axis 17 with respect to the vertical direction V have a directional component that is oriented parallel to the direction of transport T. Alternatively or additionally, the sheet delivery unit 1000 is preferably characterized in that the displacement axis 17 is arranged upstream of the at least one forward pile limiter 04 and/or upstream of the at least one sheet decelerating means 07.

Alternatively or additionally, the sheet delivery unit 1000 is preferably characterized in that, in at least one and more preferably in each displacement position, the at least one displacement member 12 is located at least partially lower than the at least one sheet decelerating means 07 and the at least one sheet infeed means 08, and more preferably also lower than the at least one sheet transfer means 09 and even more preferably lower than every component of the sheet delivery unit 1000 that transports the sheet 02 on its transport path up to the dropping point and/or that drives or decelerates said sheet in the direction of transport T.

The sheet processing machine 01 is preferably characterized in that it comprises at least one shaping unit 900 or die-cutting unit 900 and/or at least one application unit 600 and in that the sheet processing machine 01 comprises at least one sheet delivery unit 1000, which is configured as described in the foregoing and/or in the following. Alternatively or additionally, the sheet processing machine 01 is preferably characterized in that the at least one application unit 600 is configured as a flexo application unit 600 and/or as a flexo printing unit 600 and/or in that the sheet processing machine 01 comprises at least one substrate supply device 100 configured as a sheet feeder 100.

A method for operating a sheet processing machine 01 is preferred. Preferably, respective sheets 02 are processed 01 in at least one respective processing operation by means of at least one device of the sheet processing machine 01, for example are furnished with at least one application fluid and/or mechanically processed and/or altered in terms of their shape and/or die cut. The sheets 02 are preferably transported at a processing speed during their respective processing operation, in particular along the transport path provided for the transport of sheets 02.

Alternatively or additionally, the method is preferably characterized in that the sheets 02 are modified in terms of their shape in a respective shaping process. The respective shaping process is preferably a respective die-cutting process, in which the respective sheet 02 is die cut, with parts of the sheet 02 being removed, in particular, forming scrap pieces.

Alternatively or additionally, the method is preferably characterized in that in a respective separation process the sheets 02 are freed from the scrap pieces, for example by being jogged. During said process the respective sheets 02 are preferably transported by means of the at least one separation transport means 904.

Alternatively or additionally, the method is preferably characterized in that in a respective transport process, in particular immediately following the respective separation process, the sheets 02 are transported along the transport path provided for the transport of sheets 02 to the sheet delivery unit 1000, in particular by means of the output transport means 906, which is preferably configured as an upper suction transport means 906, and/or in a hanging state.

Alternatively or additionally, the method is preferably characterized in that, in a respective infeed process, substrate 02, in particular processed substrate in the form of a sequence of sheets 02 that are spaced apart from one another in the direction of transport T, is preferably fed in this direction of transport T, in particular at a transfer speed, to the sheet delivery unit 1000 of the sheet processing machine 01. The transfer speed is preferably the same as the processing speed. The infeed process is preferably the process in which the respective sheets 02 transported in the transport process are transferred, in particular in a hanging state, from the output transport means 906 to the at least one sheet transfer means 09. Alternatively, if rather than a series of output transport means 906 and sheet transfer means 09, only one selective transport means 09; 906 is provided, said selective transport means may be omitted and the infeed process can be carried out immediately following the respective separation process.

Alternatively or additionally, the method is preferably characterized in that, at least during a sheet decelerating process and/or during an imbricating process, at least two sheets 02 are guided, at least temporarily, in a hanging state by means of an upper sheet transport system 06 of the sheet delivery unit 1000 that is configured for the hanging transport of sheets 02 and are transported in an imbricated arrangement at least also in the direction of transport T.

Alternatively or additionally, the method is preferably characterized in that, in particular in a respective deceleration transfer process, the sheets 02 are transported in each case in a hanging state by means of the at least one sheet infeed means 08 of the sheet delivery unit 1000, configured as upper suction transport means 08, and are transferred by the same to the at least one sheet decelerating means 07 configured as upper suction transport means 07 and more preferably arranged at least partially downstream of the at least one sheet infeed means 08, as viewed in the direction of transport T. The at least one sheet decelerating means 07 preferably serves to decelerate the sheets 02 from the processing speed and/or transfer speed so that they can be deposited on the delivery pile 28.

Alternatively or additionally, the method is preferably characterized in that, in particular in a respective displacement process, a respective trailing end 29 of a respective leading sheet 02 is forced downward away from the at least one sheet infeed means 08 by means of at least one displacement element 12. Alternatively or additionally, the method is preferably characterized in that, in the displacement process, the respective trailing end 29 of the respective leading sheet 02 is forced downward away from the at least one sheet infeed means 08 by means of the at least one displacement element 12, at least also upstream of the at least one forward pile limiter 04 with respect to the direction of transport T. Meanwhile, the leading end 31 of the respective leading sheet 02 is preferably in contact with a transport surface 22 of the at least one sheet decelerating means 07. During the respective displacement process, at least a rear section of the leading sheet 02 preferably moves out of contact with the at least one sheet infeed means 08, although this rear section of the leading sheet 02 is still situated below the at least one sheet infeed means 08 in the vertical direction V. This creates an imbrication gap between the respective rear section of the leading sheet 02 on the one hand and the at least one sheet infeed means 08, in particular its contact surface 16, on the other.

By activating the at least one displacement element 12, a distance in the vertical direction V between the at least one sheet decelerating means 07 and the respective leading sheet 02 is preferably created and/or enlarged for at least part of the respective leading sheet 02.

Alternatively or additionally, the method is preferably characterized in that in the sheet decelerating process, this respective leading sheet 02 is decelerated, in particular with respect to movement in the direction of transport T, by means of the at least one sheet decelerating means 07. The respective sheet 02 is preferably decelerated in that the respective sheet 02 is pulled against a transport surface 22 of the at least one sheet decelerating means 07 by means of a vacuum, and the transport surface 22 is decelerated. The transport surface 22 of the at least one sheet decelerating means 07 is preferably decelerated in that a decelerating means drive 19 that drives the at least one sheet decelerating means 07 is operated at a decreasing speed, in particular in the form of an at least partially predefined deceleration profile. During its deceleration process the respective sheet 02 is preferably held or touched only on its upper side with respect to the vertical direction V.

The respective sheet decelerating process of a respective sheet 02 preferably begins before the respective displacement process of said sheet 02 begins. The respective displacement process of a respective sheet 02 preferably takes place at least partly simultaneously with the respective sheet decelerating process of the respective sheet 02. The respective displacement process of a respective sheet 02 preferably ends before the respective sheet decelerating process of the respective sheet 02 is completed. The at least one displacement element 12 is preferably deactivated to end the respective displacement process. If the displacement element 12 is configured as a displacement opening 12, the emission of the displacement fluid is correspondingly reduced and/or interrupted and/or terminated for this purpose. If the displacement element 12 is configured as a displacement member 12, said displacement member 12 is preferably moved upward until it moves out of contact with the respective leading sheet 02. The respective trailing end 29 of the respective leading sheet 02 moves upward again upon and/or after completion of the respective displacement process of said sheet 02, for example. However, due to an imbrication that has taken place in the meantime, at least the respective trailing end 29 of the respective leading sheet 02 remains at a distance from the transport surface 23 of the at least one sheet infeed means 08 and from the transport surface 22 of the at least one sheet decelerating means 07 with respect to the vertical direction V.

The imbrication preferably takes place in a respective imbricating process and/or by means of the at least one imbricating device 46. The imbricating process is preferably assigned to at least two sheets 02, in particular the leading sheet 02 and the succeeding sheet 02. In the imbricating process, these sheets are preferably placed in an imbricated arrangement relative to one another as they are transported further in the direction of transport T. Alternatively or additionally, the method is preferably characterized in that in the imbricating process, a respective leading end 31 of a respective sheet 02, in particular succeeding the respective leading sheet 02, is pushed, in particular by means of the at least one sheet transfer means 09, between the trailing end 29 of the respective leading sheet 02 and the at least one sheet infeed means 08, with respect to the vertical direction V, while the respective leading sheet 02 is still partially held by the at least one sheet decelerating means 07. Therefore, the leading sheet does not have to be fully detached from or halted by the at least one sheet decelerating means 07 when the succeeding sheet 02 is already less than its sheet length away from the rear sheet stop 03.

Alternatively or additionally, the method is preferably characterized in that transport rollers 26 of the at least one sheet infeed means 08 are driven in rotation exclusively by the contact of these transport rollers 26 with the respective moving sheet 02, and/or in that as sheets 02 are being transported along the at least one sheet infeed means 08, they slide at least intermittently along at least one sliding surface of the at least one sheet infeed means 08. If, as preferred, the at least one sheet infeed means 08 is configured as a roller suction system 08 and has passively rotatable transport rollers 26, those transport rollers 26 of the at least one sheet infeed means 08 that are still in contact with the leading sheet 02 can rotate at a different circumferential speed from those transport rollers 26 of the at least one sheet infeed means 08 that are already in contact with the succeeding sheet 02. Both sheets 02 are nevertheless reliably transported, for example by the vacuum of the at least one sheet infeed means 08.

The at least one displacement member 12 is preferably moved by means of a predefined movement profile. At least a part of the at least one displacement member 12 is preferably guided from above to beneath the reference surface 11, where it occupies the displacement region, which moves along with the at least one displacement member 12, in particular. This preferably occurs in such a way that the at least one displacement member 12 is in contact with approximately the same point on the succeeding sheet 02 for as long as possible. A constant negative acceleration of the leading sheet 02 results in a parabolic curve of the position with respect to the direction of transport T of the trailing end 29 of the leading sheet 02 over time. Preferably, the position with respect to the direction of transport T of the at least one displacement member 12, plotted over time, follows a parabolic curve, at least until shortly before the respective leading end 31 of the succeeding sheet 02 would overtake the at least one displacement member 12. From that point on, the at least one displacement member 12 is preferably moved in the direction of transport T at a constant speed that corresponds to the speed of the second sheet 02 and in particular is equal to the transfer speed and/or the processing speed.

During the displacement process, the displacement region is preferably moved away to form at least a clearance upstream of the succeeding sheet 02 in the direction of transport T by a movement of the at least one displacement member 12, in particular as long as the at least one displacement member 12 is positioned at least partially beneath the reference surface 11 and the succeeding sheet 02 has not yet entered the imbrication gap. The clearance is preferably at least 1 mm, more preferably at least 2 mm, even more preferably at least 5 mm, and more preferably still at least 8 mm. Independently of this, the clearance is preferably no more than 50 mm, more preferably no more than 20 mm, and even more preferably no more than 12 mm. The smaller the clearance, the more sheets 02 can be processed per unit of time and/or the more gently the sheets 02 can be decelerated, in particular given a predetermined position of the at least one displacement member 12. Alternatively or additionally, the method is preferably characterized in that at least one sheet per second is deposited onto the delivery pile 28 by means of the sheet delivery unit 1000, more preferably at least two sheets 02 per second, even more preferably at least 2.5 sheets 02 per second, even more preferably at least three sheets 02 per second, and more preferably still at least 3.2 sheets 02 per second.

As the at least one displacement member 12, the at least one displacement lever 12 is preferably used, which is arranged such that it is rotatable about the displacement axis 17. The rotational movement of the at least one displacement lever 12 preferably follows a specified profile such that its position over time with respect to the direction of transport T behaves as described above.

Alternatively or additionally, the method is preferably characterized in that the at least one displacement element 12 is configured as a displacement member 12 and in the displacement process is moved at least partially to below a transport surface 23 of the at least one sheet infeed means 08. Alternatively or additionally, the method is preferably characterized in that the at least one displacement element 12 is configured as a displacement lever 12 that can be turned, in particular pivoted, and more preferably rotated about a displacement axis 17 and in the displacement process is turned, in particular pivoted and/or rotated, in particular in the direction of rotation D, at least partially about the displacement axis 17 to a point below a transport surface 23 of the at least one sheet infeed means 08. Alternatively or additionally, the method is preferably characterized in that during the displacement process 08, the at least one displacement element 12 is situated at least partially below the reference surface 11 of the at least one sheet infeed means 08. Alternatively or additionally, the method is preferably characterized in that the position of the at least one displacement element 12 with respect to the direction of transport T follows a predefined movement profile, in particular, as a function of time, at least during the displacement process. Alternatively or additionally, the method is preferably characterized in that the movement profile has at least one parabolic section and at least one linear section.

Alternatively or additionally, the method is preferably characterized in that in a detachment process, the respective leading sheet 02 is detached completely from the at least one sheet decelerating means 07, in particular by means of the at least one dropping means 32. The detachment process preferably begins after the displacement process has begun. The detachment process can begin even before the displacement process is completed. Alternatively or additionally, the method is preferably characterized in that in the detachment process, lowering occurs first at the first connection point 41 after which lowering occurs at a second connection point 42, which, as described, is preferably located downstream of the first connection point 41 with respect to the direction of transport T. Overall, the leading sheet 02 is preferably detached from the upper sheet transport system 06 in that first, its trailing end 29 is detached from the upper sheet transport system 06 and in particular from the at least one sheet infeed means 08 by means of the at least one displacement element 12, and in that a part of the leading sheet 02 that is located further forward in the direction of transport T is then detached from the upper sheet transport system 06 and in particular from the at least one sheet decelerating means 07 by means of the at least one dropping means 32, in particular by means of a part of the at least one dropping means 32 that can be lowered by means of the at least one first dropping drive 33, and in that the leading end 29 of the leading sheet 02 that is located further forward in the direction of transport T is then detached from the upper sheet transport system 06 and in particular from the at least one sheet decelerating means 07 by means of the at least one dropping means 32, in particular by means of a part of the at least one dropping means 32 that can be lowered by means of the at least one second dropping drive 34.

Alternatively or additionally, the method is preferably characterized in that following the detachment process, the at least one sheet decelerating means 07 is accelerated again, in particular to the transfer speed and/or to the processing speed, after which the respective succeeding sheet 02 is brought into contact with the at least one sheet decelerating means 07. The sheet 02 that previously was the succeeding sheet thereby becomes a new leading sheet 02 and the method can be repeated or continued accordingly.

Alternatively or additionally, the method is preferably characterized in that, in a stacking process, the respective sheet 02 that has just been detached is deposited downward from the at least one sheet decelerating means 07 onto a delivery pile 28. The delivery pile 28 is thereby increased by said leading sheet 02. The delivery pile 28 is preferably formed between the at least one forward pile limiter 04 and the at least one rear sheet stop 03. The at least one rear sheet stop 03 is preferably adjustable in terms of its position with respect to the direction of transport T along a format adjustment path. This enables adjustments to different sheet lengths to be made, in particular a one-time adjustment in the event of a format change. The at least one rear sheet stop 03 establishes a rear boundary of the delivery pile. A forward boundary of the delivery pile 08 is preferably established by the at least one forward pile limiter 04. The at least one forward pile limiter 04 is preferably movable, in particular periodically movable, with respect to the direction of transport T along a pile forming path. In this way, the delivery pile 28 can be brought into shape, in particular by pushing respective sheets 02 in the direction of transport T so as to produce uniform forward and/or rear boundaries of the delivery pile 28. Periodic movements of the at least one forward pile limiter 04 are preferably carried out multiple times during operation of the sheet processing machine 01, for example multiple times per minute. Lateral pile limiters are also provided, for example. The lateral pile limiters are preferably adjustable, based on the sheet format, in terms of their position with respect to the transverse direction A, and/or in particular are periodically movable with respect to the transverse direction A, in order to bring at least one lateral boundary surface of the delivery pile 28 into shape.

While preferred embodiments of a sheet processing machine with shaping device and upper suction transport means, in accordance with the present invention, have been set forth fully and completely hereinabove, it will be apparent to one of skill in the art that various changes could be made thereto, without departing from the true spirit and scope of the present invention, which is accordingly to be limited only by the appended claims.

The invention claimed is:

1. A sheet processing machine comprising:

at least a first shaping device;

at least a first sheet delivery unit arranged downstream of the at least first shaping device along a transport path provided for a transport of sheets, the at least first shaping device having at least a first shaping point, which is formed by one of at least a first forme cylinder and at least a first impression cylinder;

at least a first separation device configured as at least a first jogging device and being usable for removing scrap pieces from sheets being transported, the at least first separation device being arranged downstream of the at least first shaping point along the transport path provided for the transport of sheets, the at least first separation device having at least a first separation transport device;

at least a first selective transport device, the at least first selective transport is device being arranged following the at least first separation transport device along the transport path provided for the transport of sheets, the at least first selective transport device being configured as having at least a first upper suction transport device for a hanging transport of sheets;

at least a first sheet decelerating device arranged downstream of the at least first selective transport device along the transport path provided for the transport of sheets, the at least first sheet decelerating device being arranged at least partially above a delivery pile carrier of the sheet delivery unit, and;

at least a first sheet diverter for channeling sheets onto a bypass sheet transport path that bypasses the at least first sheet decelerating device, the at least first sheet diverter being arranged between the at least first separation device, and the at least first sheet decelerating device, along the transport path provided for the transport of sheets.

2. A sheet processing machine comprising:

at least a first shaping device;

at least a first sheet delivery unit, arranged downstream of the at least first shaping device along a transport path provided for a transport of sheets, the at least first shaping device having at least a first shaping point, which is formed by one of at least a first forme cylinder, and at least a first impression cylinder;

at least a first separation device for removing scrap pieces from sheets being transported, the at least first separation device being arranged downstream of the at least first shaping point along the transport path provided for the transport of sheets, the at least first separation device having at least a first separation transport device;

at least a first selective transport device, the at least first selective transport device being arranged following the at least first separation transport device along the transport path provided for the transport of sheets, the at least first selective transport device being configured as at least a first upper suction transport device for a hanging transport of sheets;

a second transport device, which is configured as one of a second upper suction transport device and as a hanging sheet transport device, the second transport device being arranged extending continuously from a point downstream of the at least first separation transport device to a point above a delivery pile carrier of the sheet delivery unit along the transport path provided for the transport of sheets;

at least a first sheet decelerating device, the at least first sheet decelerating device being arranged downstream of the at least first selective transport device along the transport path provided for the transport of sheets, and being arranged at least partially above a delivery pile carrier of the sheet delivery unit; and at least a first sheet diverter, the at least first sheet diverter being usable for channeling sheets onto a bypass transport path that bypasses the at least first sheet decelerating device, the at least first sheet diverter being arranged between the at least first separation device and the at least first sheet decelerating device other, along the transport path provided for the transport of sheets.

3. The sheet processing machine according to claim 1, wherein at least a first sheet imbricating device is arranged between the at least first selective transport device and the at least first sheet decelerating device, along the transport path provided for the transport of sheets, the at least first sheet imbricating device having at least a first sheet imbricating transport device configured as one of a second upper suction transport device and as a sheet infeed device.

4. The sheet processing machine according to claim 3, wherein the at least second upper suction transport device of the at least first sheet imbricating device is configured as a passively driven suction transport means.

5. The sheet processing machine according to claim 1, wherein the at least first sheet delivery unit has at least a first forward pile limiter, and wherein a delivery pile area is delimited at least by at least a first rear sheet stop and by the at least first forward pile limiter, and wherein the at least first sheet delivery unit has at least a first upper sheet transport system configured for a hanging transport of sheets, and which at least first upper sheet transport system has at least a first imbricating device, and wherein the at least first imbricating device serves to produce sheet imbrication for an imbricated, hanging transport of at least two sheets at at least one point located above the delivery pile area, as viewed in a vertical direction.

6. The sheet processing machine according to claim 5, wherein a transport direction is a horizontal direction oriented from the at least first forward pile limiter toward the at least first rear sheet stop, and wherein the at least first upper sheet transport system configured for the hanging transport of sheets has at least a second sheet infeed device configured as a second upper suction transport device and has the at least a first sheet decelerating device configured as the first upper suction transport device, and wherein the at least second sheet infeed device is arranged at least partially upstream of the at least first sheet decelerating device with respect to the transport direction and extends beyond the at least first forward pile limiter, and wherein at least a first downwardly acting, activatable displacement element is arranged in the region of the at least second sheet infeed device with respect to the transport direction.

7. The sheet processing machine according to claim 6, wherein the at least first downwardly acting, activatable displacement element is configured as at least a first displacement member, a position of which can be changed between at least one pass-through position and at least one displacement position, at least by at least a first displacement drive.

8. The sheet processing machine according to claim 1, wherein the at least first shaping device is configured as a rotary die-cutting device.

9. The sheet processing machine according to claim 1, wherein the transport devices are arranged extending continuously from a point downstream of the at least first separation transport device to a point above a delivery pile carrier of the sheet delivery unit along the transport path provided for the transport of sheets, the transport devices at least also being configured as ones of upper suction transport devices and as transport devices for sheets, and configured for a hanging transport of sheets.

10. The sheet processing machine according to claim 1, one of wherein the at least first separation device is configured as the at least first jogging device, wherein the at least first separation transport device is configured to one of act and to be capable of acting both from above and from below on sheets, and wherein the at least first separation device has at least one collecting device for scrap pieces arranged beneath the transport path provided for the transport of sheets, and wherein the at least first separation transport device has one of multiple upper separation transport belts arranged side by side and spaced apart from one another in a transverse direction and has multiple lower separation transport belts arranged side by side and spaced apart from one another in a transverse direction and wherein the at least first separation device has at least one jogging drive and wherein the at least first separation transport device has at least one transport drive, by the use of which at least first separation transport device, at least a first component of the at least first separation transport device can be driven in circulation.

11. The sheet processing machine according to claim 1, wherein the sheet processing machine further has at least a first die-cutting unit and has at least a first application unit.

12. The sheet processing machine according to claim 11, wherein the at least first application unit is configured as one of a flexographic application unit and as a flexographic printing unit.

13. The sheet processing machine according to claim 11, wherein the at least first application unit has at least a second forme cylinder, which at least second forme cylinder is arranged below an impression cylinder that cooperates with the at least second forme cylinder.

14. The sheet processing machine according to claim 12, wherein, in each of the units of the sheet processing machine, a section of a transport path provided for the transport of sheets, and which is defined by the at least first application unit is at least substantially flat.

15. The sheet processing machine according to claim 1, wherein the at least first forme cylinder of the shaping device is arranged above the at least first impression cylinder that cooperates with it.

* * * * *